US009663902B2

(12) United States Patent
Penland, Jr. et al.

(10) Patent No.: US 9,663,902 B2
(45) **Date of Patent: *May 30, 2017**

(54) ENVIRONMENTALLY RESISTANT ENCAPSULATED MAT CONSTRUCTION

(71) Applicant: QUALITY MAT COMPANY, Beaumont, TX (US)

(72) Inventors: Joe Penland, Jr., Beaumont, TX (US); Rustin Penland, Beaumont, TX (US); Scott Calvert, Beaumont, TX (US); Thomas O'Brien, Wanaka (NZ)

(73) Assignee: Quality Mat Company, Beaumont, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/056,344

(22) Filed: Feb. 29, 2016

(65) Prior Publication Data

US 2016/0177516 A1 Jun. 23, 2016

Related U.S. Application Data

(63) Continuation-in-part of application No. 14/839,900, filed on Aug. 28, 2015, now Pat. No. 9,315,951, which is a continuation-in-part of application No. 14/855,336, filed on Sep. 15, 2015.

(60) Provisional application No. 62/052,954, filed on Sep. 19, 2014, provisional application No. 62/159,909, (Continued)

(51) Int. Cl.

| | |
|---|---|
| ***E01C 9/08*** | (2006.01) |
| ***E01C 5/14*** | (2006.01) |
| ***E01C 5/22*** | (2006.01) |

(52) U.S. Cl.
CPC ..... *E01C 9/086* (2013.01); *E01C 5/14* (2013.01); *E01C 5/22* (2013.01)

(58) Field of Classification Search
CPC ... E01C 9/08; E01C 9/086; E01C 5/00; E01C 5/14; E01C 11/24
See application file for complete search history.

(56) References Cited

U.S. PATENT DOCUMENTS

| | | | |
|---|---|---|---|
| 2,836,529 | A | 5/1958 | Morris |
| 4,462,712 | A | 7/1984 | Penland, Sr. |
| 4,629,358 | A | 12/1986 | Springston et al. |

(Continued)

FOREIGN PATENT DOCUMENTS

| | | | |
|---|---|---|---|
| CA | 2 233 776 | A1 | 12/1999 |
| EP | 2 705 950 | A1 | 3/2014 |

(Continued)

OTHER PUBLICATIONS

U.S. Appl. No. 14/839,900, Non-Final Rejection, Oct. 29, 2015.

(Continued)

*Primary Examiner* — Abigail A Risic
(74) *Attorney, Agent, or Firm* — Winston & Strawn LLP

(57) ABSTRACT

An industrial mat that includes a core construction that provides strength and rigidity to the mat, with the core construction including various layers or plies of components at least some of which are typically made of wood or engineered wood; and a durable skin that surrounds and encapsulates at least the wood components of the mat or the entire core construction. The skin has a thickness sufficient to provide environmental resistance to the wood components or to the core construction to which it is applied. The skin also provides abrasion resistance to the boards and mat.

20 Claims, 22 Drawing Sheets

Related U.S. Application Data filed on May 11, 2015, provisional application No. 62/138,127, filed on Mar. 25, 2015.

(56) References Cited

U.S. PATENT DOCUMENTS

| | | | |
|---|---|---|---|
| 4,889,444 | A | 12/1989 | Pouyer |
| 5,020,937 | A | 6/1991 | Pouyer |
| 5,139,845 | A | 8/1992 | Beckerman et al. |
| 5,163,776 | A | 11/1992 | Pouyer |
| 5,273,373 | A | 12/1993 | Pouyer |
| 5,342,260 | A | 8/1994 | Markland |
| 5,653,551 | A | 8/1997 | Seaux |
| 5,822,944 | A | 10/1998 | Penland, Sr. |
| 5,888,612 | A | 3/1999 | Needham et al. |
| 6,214,428 | B1 | 4/2001 | Henderson |
| 6,231,994 | B1 | 5/2001 | Totten |
| 6,380,309 | B1 | 4/2002 | Parker et al. |
| 6,474,905 | B1 | 11/2002 | Smith, Jr. |
| 6,497,956 | B1 | 12/2002 | Phillips et al. |
| 6,511,257 | B1 | 1/2003 | Seaux et al. |
| 6,649,110 | B1 | 11/2003 | Seaux et al. |
| 6,662,508 | B1 | 12/2003 | Else |
| 6,695,527 | B2 | 2/2004 | Seaux et al. |
| 6,722,831 | B2 | 4/2004 | Rogers et al. |
| 6,821,623 | B2 | 11/2004 | Kvesic |
| 7,137,226 | B2 | 11/2006 | Fiutak et al. |
| 7,303,800 | B2 | 12/2007 | Rogers |
| 7,404,690 | B2 | 7/2008 | Lukasik et al. |
| 7,413,374 | B2 | 8/2008 | Rogers et al. |
| 7,427,172 | B2 | 9/2008 | Lukasik |
| D609,956 | S | 2/2010 | Lukasik |
| 7,818,929 | B2 | 10/2010 | Fiutak et al. |
| 7,934,885 | B2 | 5/2011 | Fournier |
| 8,061,929 | B2 | 11/2011 | Dagesse |
| 8,088,477 | B2 | 1/2012 | Curtis et al. |
| 8,382,393 | B1 | 2/2013 | Phillips |
| 8,613,373 | B2 | 12/2013 | Holtby et al. |
| 8,784,001 | B1 | 7/2014 | Phillips |
| 8,906,480 | B2 | 12/2014 | Fiutak et al. |
| 8,936,073 | B1 | 1/2015 | Phillips |
| 9,133,598 | B2 | 9/2015 | Hsu |
| 2002/0110418 | A1 | 8/2002 | Renick |
| 2004/0037644 | A1 | 2/2004 | Renick |
| 2004/0071914 | A1 | 4/2004 | Fiutak et al. |
| 2004/0253055 | A1 | 12/2004 | Polivka, Jr. |
| 2005/0022363 | A1 | 2/2005 | Harrison |
| 2006/0265976 | A1 | 11/2006 | Fiutak |
| 2007/0056228 | A1 | 3/2007 | Penland, Sr. et al. |
| 2007/0237581 | A1 | 10/2007 | Lukasik et al. |
| 2008/0028703 | A1 | 2/2008 | Brandstrom |
| 2008/0085154 | A1 | 4/2008 | Lukasik |
| 2008/0152861 | A1 | 6/2008 | Barker |
| 2008/0292397 | A1 | 11/2008 | Farney et al. |
| 2009/0087261 | A1 | 4/2009 | Fournier |
| 2009/0301004 | A1 | 12/2009 | Dagesse |
| 2011/0233363 | A1 | 9/2011 | Wold |
| 2011/0280657 | A1 | 11/2011 | Martinez |
| 2012/0063844 | A1 | 3/2012 | Wold |
| 2013/0284872 | A1 | 10/2013 | Tubbs |
| 2013/0306804 | A1 | 11/2013 | Holtby et al. |
| 2013/0318896 | A1 | 12/2013 | Rogers |
| 2014/0154462 | A1 | 6/2014 | Fiutak et al. |
| 2014/0183319 | A1 | 7/2014 | Tubbs |
| 2014/0193196 | A1 | 7/2014 | Fournier |
| 2014/0199119 | A1 | 7/2014 | Stasiewich |
| 2014/0205377 | A1 | 7/2014 | Hill |
| 2014/0341649 | A1 | 11/2014 | Bryan et al. |

FOREIGN PATENT DOCUMENTS

| | | | |
|---|---|---|---|
| WO | 95/25076 | A1 | 9/1995 |
| WO | 2006/002507 | A1 | 1/2006 |
| WO | 2006/048654 | A1 | 5/2006 |
| WO | 2007/112537 | A1 | 10/2007 |

OTHER PUBLICATIONS

U.S. Appl. No. 14/839,900, Notice of Allowance, Jan. 20, 2016.
U.S. Appl. No. 14/855,336, Non-Final Rejection, Feb. 9, 2016.
Forest Products Laboratory. Wood Handbook—Wood as an Engineering Material—4. Mechanical Properties of Wood. U.S. Department of Agriculture. Online version available at: app.knovel.com/hotlink/pdf/id:kt0052LP04/wood-handbook-wood-an/mechanical-properties (1999).
"Inflammable". Wiktionary. Archived Sep. 6, 2014.
International Search Report and Written Opinion, Appl. No. PCT/US2016/020081, Jun. 2, 2016.
Invitation to Pay Additional Fees, Appl. No. PCT/US2016/020067, Jun. 20, 2016.
U.S. Appl. No. 14/855,336, Final Rejection, Jun. 16, 2016.
U.S. Appl. No. 14/855,336, Notice of Allowance, Sep. 16, 2016.

ENVIRONMENTALLY RESISTANT ENCAPSULATED MAT CONSTRUCTION

CROSS-REFERENCE TO RELATED APPLICATIONS

This application is a continuation-in-part of U.S. application Ser. No. 14/839,900 filed Aug. 28, 2015, which claims the benefit of application No. 62/052,954 filed Sep. 19, 2014. This application is also a continuation-in part of U.S. application Ser. No. 14/855,336 filed Sep. 15, 2015 and claims the benefit of U.S. provisional applications Nos. 62/159,909 filed May 11, 2015 and 62/138,127 filed Mar. 25, 2015. The entire content of each of the foregoing applications is expressly incorporated herein by reference thereto.

BACKGROUND

The present invention relates to a reusable system for the construction of roadways and equipment support surfaces in areas having poor ground integrity characteristics. More particularly, the present invention relates to a system of durable mats which can be interconnected to form roadways and/or equipment support surfaces. More particularly still, the present invention relates to a reusable system of mats which can be quickly and easily positioned in a single layer to form roadways and/or equipment support surfaces, and which can thereafter be easily removed and stored until needed again.

Mats for this use are generally known in the art and are available from Quality Mat Company, Beaumont, Tex. In remote and unstable environments, a stable roadway (or any roadway) often does not exist, such that temporary roadways are assembled by aligning planks, boards or mats along the desired path. The mats provide temporary structures for various construction projects as well as for use in environmental or disaster cleanup projects. These mats enable trucks and other equipment to drive over, store equipment on, or create campsites on otherwise unstable, soft or moist land or damaged areas by providing a relatively level and stable surface.

While conventional wood mats provide useful service at a reasonable cost, the wood core, which is typically made of white oak, can deteriorate over time due to moisture causing gradual rotting and degradation of the wood material. This causes the mat to be discarded, because unlike some of the other materials that are used on the upper and lower layers of the mat, the core cannot be replaced without essentially making an entirely new mat.

While various mats exist for such uses, there is a need for mats having improved resistance to wood deterioration as well as to abuse of and damage to the mats in order to extend their service lives. The present invention now provides new mat constructions that meet this need.

SUMMARY OF THE INVENTION

The invention relates to an industrial mat comprising a core construction that provides strength and rigidity to the mat, and an encapsulation of a thermoplastic, thermosetting or elastomeric material or a mixture thereof that surrounds and fully encapsulates at least each of the wood components or the entire core construction.

The core construction comprises a variety of different materials and components, including:

(a) plural layers or plies of wood or engineered wood components that are nailed, bolted or riveted together to form a rigid core construction, or (b) a layer or ply of a thermoplastic material in the form of a plurality of adjacently arranged elongated members or a sheet member that optionally includes open or closed cells therein or therethrough, or (c) a thermosetting plastic support structure in the form of a plate, beam, grid, grating, ladder or pultruded tubes, or (d) a metal support structure in the form of beams that are welded together to form a frame or ladder structure, or a plate that optionally contains apertures therein, or (e) at least two layers or plies of elongated, sheet, plate, beam, grid, grating, ladder or tube members wherein the layers or plies are fastened or joined together.

The encapsulation has a thickness sufficient to provide environmental resistance to the wood components or core construction that it encapsulates, while also providing abrasion resistance to the mat. Also, when the entire core structure is encapsulated, the encapsulation also forms top and bottom surfaces of the mat.

Advantageously, each layer, ply or support structure has a length and width that substantially corresponds to that of the mat and has a thickness of not less than 0.75 inches and not more than about 12 inches or between about 1 and about 8 inches or between about 1.5 and about 4 inches.

The entire core structure may be encapsulated with the top surface, the bottom surface, or both the top and bottom surfaces of the mat including a plurality of channels or grooves to provide traction to objects moving on the top surface of the mat and/or to provide resistance to slipping when the bottom surface of the mat is placed on wet or muddy ground surfaces.

The core construction is preferably made of materials that provide a load bearing capacity that is able to withstand a load of at least 600 to 800 psi without permanently deforming the core construction and the encapsulation has a thickness of 0.25 to 1 inch or 0.25 to 0.5 inch.

In various preferred embodiments, the core construction comprises:

- two or three layers or plies of elongated components or members at least some or all of which are wood or engineered wood, wherein each layer or ply comprises wood or engineered wood in the form of a plurality of adjacently arranged elongated members or a sheet member; or
- one of the layers or plies comprising a structure of a thermoplastic material in the form of a plurality of adjacently arranged elongated members or a sheet member, and another layer or ply comprising a plurality of adjacently arranged elongated members or a sheet member of engineered wood or a thermosetting plastic material; or
- one of the layers or plies comprising one or more elongated components or members of metal and another layer or ply comprising a plurality of adjacently arranged elongated members or a sheet member of wood or engineered wood; or
- one of the layers or plies comprising a reinforced thermosetting plastic support structure in the form of a plate, grid, grating, ladder or pultruded tubes and another layer or ply comprising a plurality of adjacently arranged elongated members or a sheet member of wood or engineered wood.

The core construction advantageously comprises a central layer made of a sheet, a plurality of elongated members, a plurality of compartments, or combinations thereof and at least one additional layer positioned adjacent the central layer wherein the additional layer is made of a sheet, a plurality of elongated members or combinations thereof. Furthermore, the core construction has an upper layer positioned above the central layer wherein the upper layer is made of a sheet, a plurality of elongated members or combinations thereof, and a lower layer positioned below the central layer wherein the lower layer is made of a sheet, a plurality of elongated members, a plurality of compartments, or combinations thereof.

The core construction typically comprises 2 or 3 layers containing elongated members of wood or engineered wood each having a modulus of at least about 1.6 M psi±20%. For this embodiment, the encapsulation surrounds and fully encapsulates each of the elongated wood or elongated wood members of each layer.

Generally, the encapsulation may comprise a thermoplastic, thermosetting or elastomeric material or a mixture thereof and have a thickness of 0.25 to 1 inch or 0.25 to 0.5 inch. These thicknesses are typically measured from the outer dimension of the mat although in some areas when channels or other cutouts are provided the thickness may be less. Generally, some thickness is provided so that the core construction is sealed and not exposed to water or chemicals that the mat may encounter.

Preferred encapsulation materials comprise polyethylene, polypropylene, polybutylene or a thermoplastic polyurethane, a vulcanized rubber material, a polyurethane material, an elastomeric material, a mixture of an elastomeric material and a thermosetting resin such as crumb rubber particles embedded in a polyurethane matrix. As noted, the core construction provides strength and rigidity to the mat while the encapsulation provides environmental resistance to the core construction to which it is applied.

BRIEF DESCRIPTION OF THE DRAWINGS

The appended drawing figures provide additional details of the invention, wherein.

DETAILED DESCRIPTION OF THE INVENTION

Figure 1:
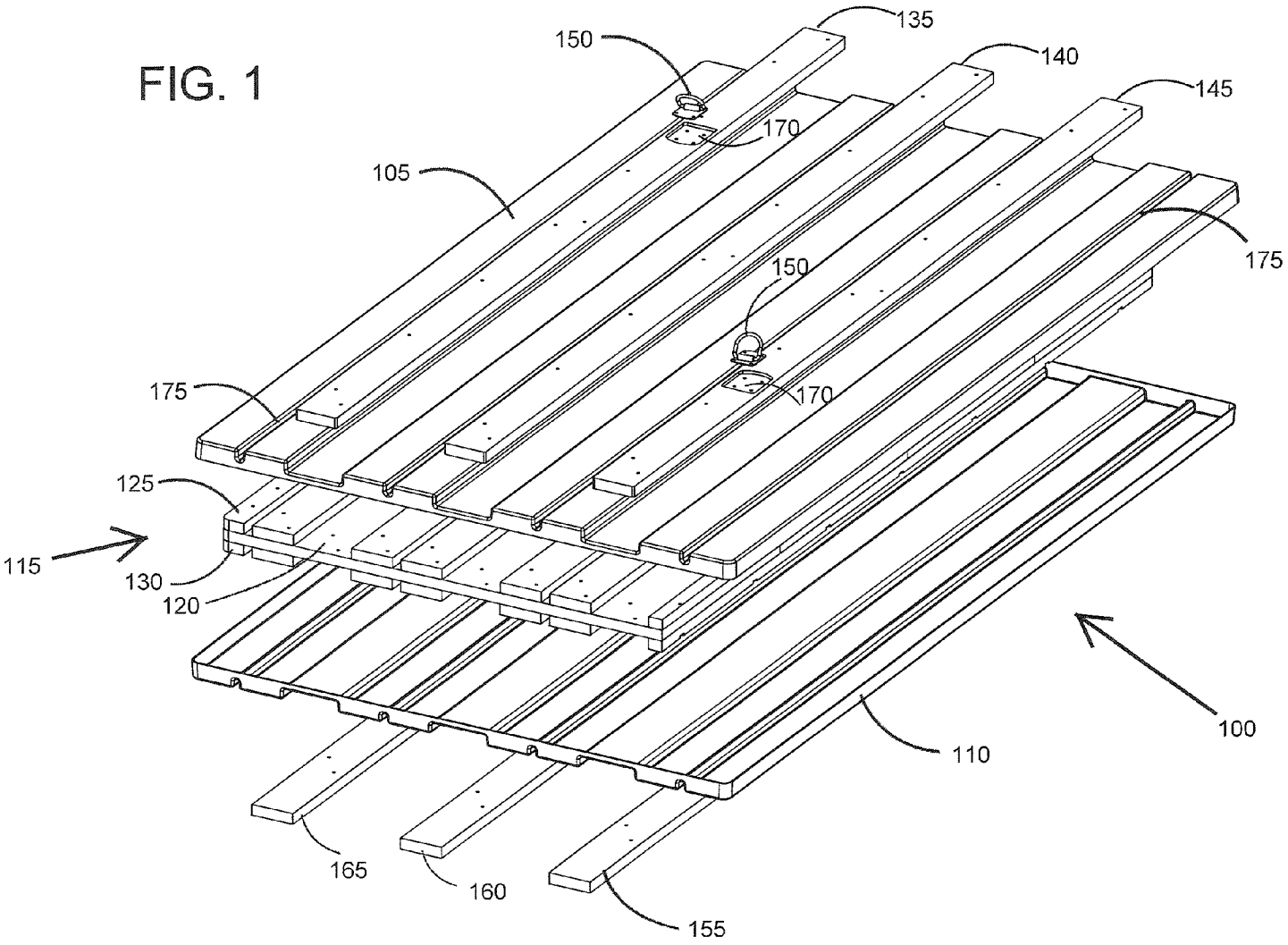
FIG. 1 is an exploded view of the mat of the invention showing the use of single width boards for the upper and lower layers, and a core construction that is encapsulated.

The present invention now provides an improved mat that possesses better environmental resistance due to the provision of an encapsulation that surrounds the wood components of the mat or the entire core construction of the mat. The encapsulation is made of an environmentally resistant material. The term "environmentally resistant material" means a material that is not subject to deterioration by water, moisture or other environmental conditions when compared to a conventional wood material such as white oak that is commonly used for such mats. This term includes thermoplastic and thermosetting materials as disclosed herein along with various elastomeric or rubber materials.

Certain terms that are used herein are defined hereinbelow to assist in the understanding of the invention.

The term "industrial mat" is intended to cover relatively large mats having widths of at least about 4 feet with lengths running from about 4 feet to 40 feet and incorporating elongated members, beams or other components having square or rectangular cross sections of sizes of at least about 1×6 to 8×8 inches with lengths from about 4 feet to as much as 40 feet or more. As noted, previous and current mats of this type that are commercially available are primarily constructed of monolithic wood.

The term "substantially" is used for its ordinary meaning to indicate that the dimensions are not precise or exact. A skilled artisan can readily determine what tolerances are acceptable to provide a surface that is considered to be flat based upon the size of the side beams and the type of service that the mat is expected to provide. There is no requirement that the beams and elongated members be flush with each other along the top and bottom surfaces of the mat. Typically, the term "substantially" will mean that the top surfaces of the beams and elongated members can vary by as much as a few inches although in the more preferred embodiments the variance is less than 1 inch.

Additionally, all dimensions recited herein are approximate and can vary by as much as ±10% to in some case ±20 or 25%. In some situations, the term "about" is used to indicate this tolerance. And when the term "about" is used before reciting a range, it is understood that the term is applicable to each recited value in the range. Often, the craftsmanship and engineering procedures that are followed in construction of these mats minimize these tolerances as much as possible or industrially practical.

In one embodiment, the present invention provides an improved mat that possesses structural integrity based on the properties and configuration of the core construction as well as abuse and abrasion resistance provided by the encapsulation. The encapsulation, also referred to as an encasement, typically includes two pieces, an upper portion and a lower portion, each generally representing half of the encapsulation. The encapsulation will be formed to allow the core construction to be completely accommodated therein, with half of the core being fit within the upper portion and half fit in the lower portion. The tolerance variation for the core construction is ±⅛" and preferably ±1/16" for all dimensions so that it will easily be received within the encapsulation. Once the core is placed inside the encapsulation, the top and bottom portions will be sealed or joined together to completely enclose the core therein.

In one embodiment, the encapsulation material is preferably a high density polyethylene made by a manufacturing process known as sheetless thermoforming technology (STF). The resulting mat is preferably an engineered wood product mat encapsulated in a sealed thermoplastic encasement. The primary advantage of this product is preservation of the wood structure contained inside as it is sealed off from the elements prior to experiencing environmental conditions during use at a jobsite.

The encapsulation is preferably made of an environmentally resistant material to protect the core construction from degradation due to weather conditions, typically moisture or water from rain or snow, as well as contact with oil, gas or other chemicals. If the mats are to be used in a particular chemical environment, the encapsulation materials can be selected for resistance against that environment. Generally, however, the encapsulation material is one that can provide water and moisture resistance for the materials that are used for the core construction. Also, the encapsulation material shall be chemically resistant to typical liquids found in the construction site. Thus, the mat will not absorb liquid contaminates so that after cleaning or washing, the mat can be removed from the work site without transporting liquid contaminates.

A wide range of polymeric materials can be used for the encapsulation of the invention. These materials include:

Acrylonitrile butadiene styrene (ABS)
Acrylic (PMA)
Celluloid
Cellulose acetate
Cyclo olefin Copolymer (COC)
Ethylene-Vinyl Acetate (EVA)
Ethylene vinyl alcohol (EVOH)
Fluoroplastics (PTFE, alongside with FEP, PFA, CTFE, ECTFE, ETFE)
Ionomers
Kydex, a trademarked acrylic/PVC alloy
Liquid Crystal Polymer (LCP)
Polyacetal (POM or Acetal)
Polyacrylates (Acrylic)
Polyacrylonitrile (PAN or Acrylonitrile)
Polyamide (PA or Nylon)
Polyamide-imide (PAI)
Polyaryletherketone (PAEK or Ketone)
Polybutadiene (PBD)
Polybutylene (PB)
Polybutylene terephthalate (PBT)
Polycaprolactone (PCI)
Polychlorotrifluoroethylene (PCTFE)
Polyethylene terephthalate (PET)
Polycyclohexylene dimethylene terephthalate (PC (PC)T)
Polycarbonate
Polyhydroxyalkanoates (PHAs)
Polyketone (PK)
Polyethylene (PE)
Polyetheretherketone (PEEK)
Polyetherketoneketone (PEKK)
Polyetherimide (PEI)
Polyethersulfone (PES)—see Polysulfone
Polyethylenechlorinates (PEC)
Polyimide (PI)
Polylactic acid (PLA)
Polymethylpentene (PMP)
Polyphenylene oxide (PPO)
Polyphenylene sulfide (PPS)
Polyphthalamide (PPA)
Polypropylene (PP)
Polystyrene (PS)
Polysulfone (PSU)
Polytrimethylene terephthalate (PTT)
Polyurethane (PU)
Polysulfone (PSU)
Polytrimethylene terephthalate (PTT)
Polyvinyl chloride (PVC)
Polyvinylidene chloride (PVDC)
Styrene-acrylonitrile (SAN)

The preferred materials are those that are moldable to form the upper and lower portions of the encapsulation, as well as those that are weldable or otherwise capable of being adhered, sealed or otherwise merged together so that the core construction can be fully encapsulated and sealed from environmental conditions.

In one embodiment, the encapsulation is molded into upper and lower portions, which are preferably identical. These portions are configured to be placed upon the upper and lower layers of the core construction. To facilitate placement of the upper and lower portions on the core construction, the components used for constructing the core are made of engineered lumber or processed white oak in order to provide close tolerances of around ±⅛$^{th}$ of an inch or less and typically around 1/16$^{th}$ of an inch. This assures that the upper and lower portions of the encapsulation will fit properly and snugly on the core construction with the peripheries of the upper and lower portions in contact so that they can be joined together by welding, adhesives, additional molding or other techniques that join and seal the portions together. This assures the complete encapsulation of the construction core in order to prevent egress of water, moisture, chemicals or other solutions that will over time cause degradation of the wood materials.

Alternatively, the encapsulation can be provided in other ways, including but not limited to immersion coating of the entire core construction into the encapsulation material, or by painting or otherwise depositing encapsulation material on all surfaces and sides of the core construction to completely encapsulate it. The encapsulation material is typically a thermoplastic polymer, a thermosetting resin or an elastomeric material. For example, the entire core construction can be coated with a thermoplastic or thermosetting resin to form a solid unitary mat structure.

One method of preparation includes placing the core construction in an enclosure and applying a liquid plastic or elastomeric material to the core construction in the enclosure in an amount sufficient to form the encapsulation as the outermost surfaces of the mat and at a thickness sufficient to protect the core construction from environmental conditions.

The enclosure is a large box or mold that can receive the core construction therein and to provide a housing for applying the plastic material therein. In one embodiment, the core construction is suspended in the enclosure and the liquid plastic is applied by spraying, painting, troweling or even pouring the plastic material onto and about the core construction.

The core construction can be suspended by being placed on supporting structures such as cones, inverted cones, pins, or rods that hold the core construction in a desired position. The cones, pins or rods are arranged throughout the bottom of the core construction and are attached thereto to evenly support it in the mold in order to provide the desired uniform spacing above, below and around it. These supports typically have a height of between about 0.25 and about 1" as they determine the thickness of the lower surface of the final mat. They are typically made of the same material as the encapsulation material so that it bond to the liquid encapsulation material and remain in the encapsulation in the final mat.

In a preferred embodiment, the supporting structures are inverted cones that has their apexes contacting the base of the mold. These cones can be made of the same material as the plastic that is to encapsulate the core or of a higher melting point material so that they do not change shape or melt when contacted by the liquid plastic that is added. The base of each cone is attached to the core by an adhesive or a fastener (screw, nail or rivet) with sufficient cones provided so that the core is securely and uniformly supported in the mold. When the plastic material is introduced into the mold, it can flow around the cones and provide a bottom surface of the mat that only has very small dots where the cone apexes contact the bottom of the mold. This provides a much better appearance than when the cone base (or a rod or cylinder) contacts the mold. And as the cones are made of the same material as the encapsulation, they blend together well in the final mat.

Alternatively, the core construction can be suspended from a wire or cord that holds the core construction in the appropriate position in the enclosure. The wire or cord is preferably made of a material that is environmentally resistant, e.g., an engineering plastic such as nylon or a rust resistant metal such as aluminum or stainless steel which again can remain in the encapsulation after the mat is made because such materials do not detract from the environmental resistance of the mat.

In another embodiment, the enclosure is a mold that is configured and dimensioned to provide a generally uniform spacing around the core construction that is suspended therein, and the liquid plastic material can be added into the mold and around the core construction to form the encapsulation around the core construction. The liquid encapsulation material (i.e., plastic or elastomer) is provided in an amount that forms a thickness of the outermost surfaces of the encapsulation that is at least about 0.25 to about 0.5 inch although it can be as thick as about 1 inch. As an example, the mold can be 8'1.5" by 12'1.5" so that it can receive a two layer wood frame that is 8' by 12'. The wood frame can be suspended about 0.75" above the bottom of the mold so that the outer surfaces of the resulting encapsulation will have a thickness on the order of about 0.75".

The upper portion of the mold is typically open and includes markings as a fill line to indicate the upper level of the added liquid encapsulation material. Also, the base of the mold is typically movable in particular upwards for assisting in ejecting the final mat from the mold after formation. The sides of the mold can be configured with very smooth surfaces or with a mold release agent to assist in allowing the mat to be ejected from the mold. A simple solution is to line all surfaces of the mold with a film of a plastic such as mylar that does not adhere strongly to the mold and that can form the outermost surfaces of the mat. When a molten encapsulation material is used, such as a molten plastic, the film can be selected to be able to resist the temperature of the molten plastic so that the final mat can easily be disengaged from the mold.

It is also possible to provide greater spacing so that the encapsulation material has a thickness of 2" to 6" at least on the elongated sides of the core construction. This thickness provides "bumpers" along the edges of the mat to prevent against damage of the core construction during use. For example, core construction of wood boards that is 7' by 11' by 4.5" thick can be placed in a mold that is 8' by 12' and 8" deep to form 6" bumpers around the mat and upper and lower encapsulation thicknesses that are each 1.75" in thickness.

One way to form the encapsulation is to fill the mold with the liquid encapsulation material so that the core construction is immersed into the liquid. This assures that all surfaces of the mat as well as at least some or most of the interstices of the core construction are provided with the plastic material that forms the encapsulation. The mold can be made of metal which is heated to soften and convert the encapsulation material to a more flowable liquid form. Alternatively, a solid or semisolid encapsulation material can be placed into the mold and heated to become softened so that the core construction can be placed onto the softened material to be embedded therein. Additional encapsulation material can be placed on the top of the core or frame construction to complete the encapsulation. These materials can be in sheet form that are heated before being placed in the mold. One sheet can be placed below the core construction and one above it. The softened sheets conform to the core construction and the edges stick together to complete the encapsulation.

For certain materials, such as thermosetting plastics, the heating of the mold will accelerate the cure of the material to more quickly form the final mat, Of course, the temperature would not be increased too high to reduce the setting time to one that would not allow a complete immersion of the mat of that would prevent the material from entering into the interstices of the mat.

Alternatively, if desired for certain materials, the mold can be cooled to assist in solidifying the encapsulation material that is injected into the mold. This would reduce the time for forming a mat when a molten plastic is used.

For either embodiment, the mold can be made in different movable sections so that after the encapsulation material forms a solid encapsulation, the mold sections can be moved apart or separated to recover the encapsulated mat from the mold.

Any one of a wide variety of plastic materials can be used in this method, including any one of the thermoplastic materials mentioned herein.

In another embodiment, the plastic material may be a liquid thermosetting plastic material that includes an activator or curing agent so that the liquid can be applied to the frame construction prior to hardening and setting to form the encapsulation. These thermosetting polymers form irreversible chemical bonds during the curing process. Thermosets do not melt, but decompose and do not reform upon cooling, so that once the encapsulation is formed around the core construction, it provides a very strong and durable encasement. Preferred thermoset materials include Epoxy, Melamine formaldehyde (MF), Phenol-formaldehyde (PF), Polyester, Polyurethane (PU), Polyimide (PI), Silicone (SI) or Urea formaldehyde (UF). These materials can be reinforced with fibers or filler (carbon, glass, metal, etc.) if desired. Thus, the core construction can be coated with a thermosetting resin to form a solid unitary encapsulated mat structure. Instead of coating, the resin can instead be applied by painting or spraying. Also, the liquid resin can be placed in the mold either before or after introduction of the core construction therein. The supports for the mat can be thermosetting or thermoplastic materials that end up becoming part of the encapsulation of the mat. And as noted herein, providing a metal mold would allow the mold to be heated to assist in curing of the thermosetting material.

Elastomeric materials that are useful for the encapsulation include:

Unsaturated rubbers that can be cured by sulfur vulcanization—these are preferred from a strength and hardness standpoint:

Natural polyisoprene: cis-1,4-polyisoprene natural rubber and trans-1,4-polyisoprene gutta-percha;

Synthetic polyisoprene;

Polybutadiene;

Chloropene rubber, i.e., polychloroprene;

Butyl rubber (i.e., copolymer of isobutylene and isoprene) including halogenated butyl rubbers (chloro butyl rubber; bromo butyl rubber);

Styrene-butadiene Rubber (copolymer of styrene and butadiene); and

Nitrile rubber (copolymer of butadiene and acrylonitrile).

Saturated (non-vulcanizable) rubbers include:

Ethylene propylene rubber (EPM);

Ethylene propylene diene rubber (EPDM);

Epichlorohydrin rubber;

Polyacrylic rubber;

Silicone rubber;

Fluorosilicone Rubber;

Fluoroelastomers;

Perfluoroelastomers;

Polyether block amides; and

Chlorosulfonated polyethylene.

The elastomeric and thermoplastic materials disclosed herein can also be provided with conventional filler materials to increase weight and hardness. They also can be reinforced with fiberglass, other fibers, fabric or metal sheets, screening or scrim to reduce elongation and provide greater rigidity.

The heating of the mold can assist in the curing of those elastomeric materials that require vulcanization or other additives that facilitate curing.

A preferred type of elastomeric or rubber material is crumb rubber which is prepared by grinding worn or discarded rubber vehicle tires. This material can be mixed with a thermoplastic or thermosetting material and set or cured in place to form the encapsulation around the mat or individual wood boards.

A preferred embodiment of the encapsulation is one that is commercially available and is typically prepared by grinding worn or discarded rubber vehicle tires to provide rubber particles. During the recycling process steel and tire cord (fluff) is removed, leaving tire rubber particles that have a granular consistency. Continued processing reduces the size of the particles further. The particles are sized and classified based on various criteria including color (black only or black and white). The granulate is sized by passing through a screen, with the size based on a dimension or mesh. The particular size for the crumb rubber of the invention is that which is between about 0.1 and about 0.4 inches and the particles are generally uniform and are within that range. These sizes maximize the area of interaction with the polyurethane to provide optimum properties to the encapsulation.

These particles can be mixed with a thermoplastic or thermosetting polyurethane forming mixture and set or cured in place to form the encapsulation around the mat. The crumb rubber encapsulation disclosed herein can also be provided with conventional filler materials to increase weight, strength or hardness. These can be added to the crumb rubber particles prior to contacting the polyurethane forming component. In some embodiments, the reinforcing materials can be added to the polyurethane forming component after contact with the crumb rubber. This can be achieved by arranging the crumb rubber particles and reinforcing material in the mold prior to introducing the polyurethane forming material therein. The reinforcing materials include inorganic particulates such as silica, alumina, mica or even sand or fine gravel, fiberglass or other fibers, or fabric or metal sheets, screening or scrim. These materials reduce elongation and provide greater rigidity to the polyurethane matrix that surrounds the crumb rubber.

The crumb rubber particles are preferably held in the encapsulation by being embedded in a polyurethane matric or binder. Polyurethane is a polymer composed of a chain of organic units joined by carbamate (urethane) links. While most polyurethanes are thermosetting polymers that do not melt when heated, thermoplastic polyurethanes are also available and either one can be used in the encapsulations disclosed herein. The thermosetting polymers are preferred for use because they are generally harder and less subject to degradation or deterioration from high temperatures. These polymers are traditionally and most commonly formed by reacting a di- or polyisocyanate with a polyol. Both the isocyanates and polyols used to make polyurethanes contain on average two or more functional groups per molecule. Any polyol and isocyanate can be used herein although it is preferred that the resulting polyurethane polymer or resin be one that has good impact and abrasion resistance and a medium hardness so that it can withstand vehicle movement thereover or equipment place thereupon without permanently deforming. Routine tests can be conducted to determine the optimum polyurethane resin (i.e., the isocyanate and polyol components) for any particular industrial mat application.

The encapsulation protects the core construction from degradation due to weather conditions, typically moisture or water from rain or snow, as well as contact with oil, gas or other chemicals. Also, the encapsulation will not absorb liquid contaminates so that after cleaning or washing, the mat can be removed from the work site without transporting liquid contaminates.

The encapsulation can be provided by a number of different techniques. For encapsulating a wood mat, a mold is prepared with a bottom surface that is configured to mimic the bottom surface of the two or three ply wood mat. The bottom surface of the mold is connected to side portions to form a well. In the particular configuration desired for a conventional three ply wood mat, the bottom surface of the mat has three elongated openings which can receive three external boards that are configured in an offset manner in order to allow interconnection of one mat with an adjacent mat.

The sides of the mold are smooth and essentially vertical. A slight draft angle may be provided to assist in removing the mat from the mold after the polyurethane sets and cures. In particular, the draft angles are a few degrees (i.e., 2 to 7) off vertical and extend outward such that the sidewalls are preferably placed at an angle of 92 or 93° with respect to the base or lower portion of the mold.

The top surface of the mold is a separate plate that is configured in a like manner as the bottom surface of the mold to provide the appropriate surface contour on the top of the mat as the lower mold surface provides on the bottom of the mat. The top and bottom mold surfaces are also configured to provide additional surface features, such as drainage channels, recesses for lifting elements, or openings for other peripherals. As shown in the drawings, a number of water removal channels are provided and these are imparted into the top surface of the encapsulation because they are configured as raised areas in the mold plate.

The mold well is first filled with approximately 0.5 to 2.5 inches of crumb rubber particles. The mold may include a fill line or other markings to indicate the upper level of the rubber crumb particulate matter that is to be introduced into the well. The crumb rubber can be added to the mold in many ways, such as with use of an air blower and pipe connected to a supply of the crumb rubber particles. Of course, the particulate matter can simply be dumped in the mold from pails or other sources to fill the mold well to the appropriate level.

Thereafter, the mat is placed into the mold with the bottom surface facing the crumb rubber. The bottom surface of the mat is also provided with positioning pins so that it is supported approximately 0.25 to 2 inches above the lower mold surface. These positioning pins can take many different forms. In one arrangement, these pins can be cones or other protrusions extending from the bottom surface of the mat. In a preferred arrangement, these pins are bolts that are screwed into holes in the mat that extend the desired distance away from the bottom of the mat so that it can be placed and situated properly in the mold. These bolts are connected to threaded openings that will later receive bolts to secure the three offset boards that are used to interconnect one mat to an adjacent mat. A sufficient number of positioning pins will be provided to properly set the mat into the mold. For a mat that is 14 feet long, at least five to seven positioning pins will be used on each location where a board will be attached for interconnection of the mat. This results in at least 15 to 21 positioning pins being provided for properly placing the mat at the correct position in the mold. The weight of the mat generally enables the pins to contact the bottom mold surface but if not the later closing of the mold will urge the mat downwardly until the pins contact the bottom mold surface.

When the mat does not have interlocking boards or other interlocking structures, the core construction can include inverted cones that has their apexes contacting the base of the structure for positioning the mat in the mold. These cones can be made of the same material as the polyurethane matrix or resin that is to encapsulate the core construction. The base of each cone is attached to the core construction by an adhesive or a fastener (screw, nail or rivet) with sufficient cones provided so that the core construction is securely and uniformly supported in the mold. When the polyurethane forming mixture is introduced into the mold, it can flow around the cones and provide a bottom surface of the mat that only has very small dots where the cone apexes contact the bottom of the mold. This provides a much better appearance than when the cone base (or a rod, bolt or cylinder) contacts the mold. And as the cones are made of the same material as the encapsulation matrix, they blend together well in the final encapsulated mat.

After the mat is positioned in the mold, it is then covered with an additional 0.5 to 2.5 inch layer of rubber crumbs which will be used to form the top surface of the encapsulation of the mat. The crumb material also is provided between the sides of the mold and the mat to provide the side encapsulation. For this the mold is configured to be 1 to 4 inches wider than the width of the mat. Alternatively, pins or spacers can be used to center the mat in the mold. Thereafter, the upper mold surface is placed upon the rubber crumb layer and is clamped in position so that the final encapsulation thickness is controlled to the desired value. The top surface of the mat can also be provided with pins in the same manner as the bottom surface so that the mat is precisely positioned between the top and bottom mold surfaces. This assures that the encapsulated mat will have an encapsulation of between at least 0.25 and 2 inches on both the top and bottom surfaces as well as the sides of the mat. The amount of polyurethane components are provided so that the encapsulation typically comprises about 55 to about 80% by weight of crumb rubber and about 20 to about 45% by weight of polyurethane.

As a specific example, the mold can be 8 feet 1.5 inches by 12 feet 1.5 inches so that it can receive a two layer wood frame that is 8 feet by 12 feet. The wood frame can be placed about 1 inch above the bottom of the mold and about 1 inch below the top mold plate so that the outer surfaces of the resulting encapsulation will have a thickness on the order of 1 inch.

Conventional internal or external mold release agents can be applied to all mold surfaces prior to starting the process in order to assure a fast release of the encapsulated mat out of the mold after the mixture has fully set and cured. These agents are generally fluorocarbon based. Alternatively, all surfaces of the mold can be provided with a paper layer or plastic film so that the polyurethane does not adhere to the mold.

After the mold is secured in position, the polyurethane forming components, i.e., a polyol/isocyanate mixture, is introduced into the mold. The resin can be introduced into different sections of the mold at a number of locations. As the mixture has a relatively low viscosity, it will fill in all voids between the crumb rubber particles and the mat or mold surfaces as well as being able to flow throughout the rubber crumb layers to saturate each particle and the spaces around it. After the mixture sets and cures, the rubber crumb particles are embedded in the final polyurethane matrix that is formed. If desired, the mold can include vacuum lines that will assist in the assuring that the polyurethane-isocyanate mixture flows throughout the rubber crumb layers. Additionally, it is possible to add some of the resin initially when the rubber crumb is added with the two being either mixed together or with the rubber crumb initially introduced into the mold followed by application of the liquid polyol/isocyanate mixture. As the mixture tends to set over time, the introduction of the resin components to the mold must be done in a relatively quick manner. For this reason it is preferred to introduce the material through various ports in the mold into the crumb rubber as soon as possible after the polyurethane and isocyanate components have been mixed together.

The preferred polyurethane forming components are those that provide low matrix or resin viscosities which in turn allow for the fast injection or introduction of the resin into the mold while providing good wetting of and penetration between the crumb rubber particles. The preferred resin system can be tailored to provide a reaction or working time of between about 5 and about 20 minutes as this enables the resin to completely fill in all spaces between the crumb particles and any openings in the core construction.

Once it is confirmed that the resin has been introduced throughout the rubber crumb particles, the mixture is allowed to cure for a sufficient period of time to form the encapsulation. The curing time will depend upon the reaction or working time and the temperature of the mold. The mold can be heated to accelerate curing if desired, but this is generally not necessary. The reaction between the polyol and isocyanate is an exothermic one and it also provides heat as well as resulting in an expansion of the material as cures. The fixing or clamping of the mold surfaces to prevent any outward expansion thus concentrates the expanding polyurethane material as a matrix in, around and between the rubber crumb particles in order to form a dense but compact encapsulation around all outer surfaces of the mat.

After the polyurethane has cured, the mold is opened by removing the top plate so that the mat can be removed from the mold. For this purpose, the lower mold surface can be provided with lifting pins or other known structures that will raise the formed mat above the bottom surface of the mold. This action combined with the draft angle provided on the sides of the mold frees the mat from being embedded in the mold and allows its removal. In some embodiments, the upper surface of the mat can be provided with lifting elements which are prevented from contacting the rubber crumb and polyurethane matrix forming mixture so that after curing of the resin and opening of the mold, these lifting elements are exposed to allow a hook from a crane or other lifting device to lift and extract the formed mat from the mold.

The molding process can be batch or continuous as desired. For a batch process, all operations are conducted on a single mold. After the mold release agents are added to the mold, a bed of rubber crumbs is initially laid in the mold well, the core construction is deposited on top of the bed of crumbs, and the additional rubber crumbs are added onto and around the core construction. The top mold surface is added and the entire unit would enter the press area where final forming would be done. After the press and curing operations are completed, the finished encapsulated mat can be removed from the mold.

An automated process is also possible. Several single molds are arranged on a circular track. A mold on a cart is provided with mold release at a first station; it then moves to a second station where an initial rubber crumb layer is added. The cart then moves to a third station where the mat is added. The cart next moves to a fourth station where additional rubber crumbs are added. The cart then is moved to a fifth station where the top mold surface is applied and the resin is introduced. The cart and fully loaded mold then moves to a sixth station where the press conducts the final forming and curing. Once out of the press, the encapsulated mat would be removed at a seventh station and the empty cart then moved back to the first station to start the process over again. Using seven carts allows the activities at each station to be conducted simultaneously and in a continuous manner on seven different molds.

As conventional mats are generally designed with spaced boards on the upper surface or layer with the spacing providing water channels to drain water from the mat, the encapsulation may also be configured with a similar design to achieve that purpose. Accordingly, the upper surface of the encapsulation is not flat but is instead configured to provide channels that match those of a conventional board mat. Alternatively, when the core construction provides a flat upper surface, the upper portion of the encapsulation can be provided with sufficient thickness to allow water channels to be provided therein. In fact, the upper portion of the encapsulation can be configured to provide molded material with spaces in the upper or lower layer as desired.

When a mat structure is to be encapsulated that has elongated members or boards on the upper and lower surfaces, the lower surface of the upper mold plate and the upper surface of the lower mold plate may each be configured to correspond or match the configuration of the boards of the mat. Alternatively, when the core construction provides a flat upper surface, the upper portion of the encapsulation can subsequently be provided with the water channels or other non-flat water drainage surfaces. In fact, the upper portion of the encapsulation can be configured to provide molded material in place of the upper layer of elongated members of the core construction. In effect the mold can be configured so that the encapsulation forms elongated rod or board like structures that mimic the upper and or lower board layers of a conventional three ply wood mat. The lower portion of the encapsulation can also be provided with openings to receive offset boards for interlocking with adjacent mats.

When the core construction is flat or has openings, greater amounts of encapsulation material can be utilized so as to form raised crumb rubber structures on the flat surfaces of the core construction, or to fill in the holes or openings in the core construction. Additionally, for flat upper and lower encapsulation can also be provided with frit, sand or other particulate matter that can form a slip resistant surface. This can also be provided on encapsulation surfaces that include water channels if desired.

The core construction housed within the encapsulation preferably comprises two or three layers: a central layer for strength and rigidity; and a layer of elongated members positioned above or below the central layer. Preferably, three layers are present. Suitable materials for the components of the upper, center and/or lower layers of the core construction include any of the materials mentioned in this application. Wood and preferably engineered wood is the most preferred due to the balance of a cost and desirable properties, but in addition, metal, thermoplastic and thermosetting materials, and elastomeric materials may be used. The elastomers are usually thermosets (requiring vulcanization) but may also be thermoplastic. These materials may be formed as elongated members or as sheet, grid or grating structures. While the encapsulation does protect the core construction from environmental conditions, the use of materials that are other than wood provides further benefits in case the encapsulation is breached or damaged.

It is also possible to use a metal plate or open metal structure as the center layer, either alone or with upper and/or lower sheeting or even as a reinforcement of a thermoplastic, thermosetting or elastomeric pad. Thus, the central layer can include multiple components that are assembled together to form the structure to which the upper and lower elongated members or boards are attached.

In a preferred embodiment, the invention relates to an industrial mat comprising a core construction that provides strength and rigidity to the mat, the core construction including plural layers or plies of components at least some or all of which are wood or engineered wood. The woods that can be used in this mat include white oak or other hardwoods that are commonly included. The invention is also operable with pine or other softwoods as these are all protected by the encapsulation.

In addition to the wood core, the core of the mat can be made of environmentally resistant materials to provide even further performance advantages. This would include one or more elongated components or members of a thermoplastic, thermosetting plastic or elastomeric materials. These materials can be provided as a solid sheet or can optionally include apertures or open or closed cells therein or therethrough. An appropriately sized grating can be used if desired. These materials optionally reinforced to provide additional strength or stiffness. Alternatively, one or more elongated components or members of metal can be used.

For certain open cell or ladder frame core construction materials, reinforcement with wood, metal or plastic, the cells can be filled with other materials to provide the desired weight to the mat. Also, reinforcements of fabrics, sheets or other cell closing materials can be used to improve stiffness and strength of the layer and if necessary to retain the filler in the cells or openings in the construction core material.

When multiple components or members are provided, they would preferably be fastened or joined together using any acceptable technique, including the use of nails, rivets or bolts or even adhesives for wood or engineered wood members or components, the bonding of different plastic components or members together using plastic welding or the same or a different resin that is compatible for bonding those materials together, or by the welding or brazing of steel, aluminum or other metal components or members.

Preferred materials for the central layer of the core construction include:

various thermosetting materials, including Epoxy, Melamine formaldehyde (MF), Phenol-formaldehyde (PF), Polyester, Polyurethane (PU), Polyurea, Polyimide (PI), Silicone (SI) or Urea formaldehyde (UF). These materials can be reinforced with fibers or filler (carbon, glass, metal, etc.). These can be provided as a sheet, grid, grating, or array of beams, or pultruded tube that optionally can be filled with foam or other filler materials;

a thermoplastic material (any of the various plastics mentioned hereinabove) and in particular, HDPE, PET and SBR as disclosed in U.S. Pat. No. 6,380,309;

a honeycomb structure with filled cells and upper and lower plate surfaces that are molded or otherwise constructed, as disclosed in U.S. Pat. No. 8,061,929;

open face filled cellular structures of thermoplastics, polyolefins or vulcanized rubber as disclosed in U.S. Pat. No. 6,511,257;

molded sheets of thermoplastic resin as disclosed in U.S. Pat. No. 5,888,612; or a reinforced plastic composite material as disclosed in U.S. Pat. No. 4,629,358.

The edges of the core construction can be protected as disclosed in US patent 2014/0193196 or with wood or synthetic laminate to avoid mechanical damage to core edges. In the present invention, plastic or elastomeric materials can also be used. These can be molded onto the longitudinal sides of the mat or secured thereto as a separate component that is bolted or screwed onto the sides of the mat.

In a most preferred embodiment, the mat includes a core construction comprising a central layer made of a sheet, a plurality of elongated members, a plurality of compartments, or combinations thereof and the entire core construction is provided with the encapsulation. The core construction can also include one or both of an upper layer positioned above the central layer and a lower layer positioned below the central layer, wherein the upper and lower layers are each made of a sheet, a plurality of elongated members, a plurality of compartments, or combinations thereof.

Preferably, each layer includes a plurality of elongated members of wood or engineered wood with the elongated members having a thickness of not less than 0.75 inches nor more than about 12 inches and preferably between about 1 and 8 inches. For convenience in manufacture, all elongated members in the core construction would have approximately the same thickness.

Preferred materials for fiberglass reinforced plastic support structures that can be used as the core construction include various thermosetting materials, including Epoxy, Melamine formaldehyde (MF), Phenol-formaldehyde (PF), Polyester, Polyurethane (PU), Polyurea, Polyimide (PI), Silicone (SI) or Urea formaldehyde (UF). These materials can be reinforced with fibers or filler (carbon, glass, metal, etc.) as desired or necessary. And while glass mat, scrim or fabric is a common form of reinforcement, other conventional reinforcement materials can be used instead of glass or fiberglass. These additional reinforcements are included in the abbreviation "FRP." A convenient form of an FRP component is as a grating. For construction materials of FRP or metal that includes an open structure or openings therein or therethrough, the openings can optionally be filled or reinforced with wood, metal or plastic materials. The openings filled with these or other materials enables the support structure to provide the desired weight to the mat. Also, reinforcements of fabrics, sheets or other closing materials for such openings can be used to improve stiffness and strength of the support structure and if necessary to separately retain the filler in the openings.

It is also possible to use a metal plate or open metal structure as the support structure or center layer of the core construction, either alone or with upper and/or lower plies or layers of other materials. Thus, the structure can include multiple components that are assembled together to form the mat. The center layer can be used alone or it can include additional layers or plies of elongated components or members, such as upper and lower layers of wood or engineered wood boards.

When metal structures are used as the core construction or as a central layer of the core construction, the metal structures may include metal lath, metal sheet or metal structures or fabrications in the form of frames, ladders, etc. Openings are typically provided to reduce the overall weight of the mat. Steel, aluminum or stainless steel are typical metals for this use. To reduce the weight of the mat when the construction core it is made of metal, a honeycomb or lathe structure may be used, or as noted the construction core may be provided with a plurality of openings. For very open structures, the openings can be filled as noted above with a material that is lighter than the metal to maintain the weight of the structure at a desired level.

Any openings or open structures of the core construction can be covered with upper and/or lower sheeting to retain filler therein. Any material can be used for the sheeting as the metal core is providing the necessary strength and rigidity to the mat. Typically, the sheeting may be plywood, plastic, metal or composite material, and can be solid or in mesh form. The sheeting can be attached to the mat by bolting or by an adhesive. The sheeting and core can be maintained in position by being sandwiched between the outer layers, with the entire support structure held together by bolting. If necessary, holes for the bolts can be drilled through the metal plate or sheeting to facilitate assembly by allowing passage of the bolts therethrough.

And in a further embodiment of the invention, the provision of apertures or openings in the core construction enables the encapsulation material to be received therein, thus forming stronger bonding of the encapsulation to the mat as it not only encapsulates the outer surfaces of the mat but it also penetrates and passes through the openings of the core structure to join the top surface of the encapsulation to the bottom surface.

Preferably, the upper, central and lower layers are nailed, bolted or riveted together to form the core construction. For a core construction where the interlocking boards (boards 3, 6 and 9 of the single width construction and the three 6" boards of the double width construction) are not included, these may be provided on top of the encapsulation. They can be bolted or nailed onto the core construction through the encapsulation, but with appropriate sealing of the encapsulation with additional material to prevent water or chemical penetration into the core construction. This arrangement provides two additional benefits. First of all, the boards placed outside of the skin are easily replaceable if damaged while the protected core remains intact. Also, this arrangement facilitates the placement of lifting elements included in boards 3 and 9 of the single width construction or in the first and third 6" boards of the double width construction.

Another preferred construction includes three layers of engineered lumber. Engineered lumber, also known as composite wood, man-made wood, or manufactured board; includes a range of derivative wood products which are manufactured by binding or fixing strands, particles, fibers, or veneers or boards of wood, together with adhesives, or other methods of fixation to form the composite material known as engineered lumber. These products are engineered to precise design specifications and tolerances which are much more controlled than ordinary wood products and meet various national or international standards and these controlled dimensions are carried over into the construction of the mat. Typically, engineered wood products are made from the same hardwoods and softwoods used to manufacture lumber.

There are three types of engineered wood that can be used in the present invention:

- parallel strand laminate (PSL), which is a beam that can be manufactured up to about 12×12 inches in any length due to the production of the beam by a continuous process;
- layered stand laminate (LSL), which is a billet that can be made at thicknesses of from about 1" to 4", in widths from about 2 inches to 54", and in lengths of about 8 feet to 64 feet; and
- layered veneer laminate (LVL) which is also a billet that can be made up to about 4 feet square by any length.

The preferred types of engineered lumber are laminated strand lumber (LSL) layered veneer laminate (LVL). The thickness of these lumber beams will be what is called 2×8 inches, which is actually approximately 1.75 inches thick but may be between 1.5 and 3 inches. Length can be as desired but will preferably be 12, 14 or 16 feet. The width of the LSL or LVL boards will vary depending upon location within the three layer mat. That is, width of the top and bottom layer boards will be approximately 8 inches (single width) or 16 inches (double width). Approximately means they may be slightly less such as 7.5 to 8.5 inches or 15 to 17 inches. Of course, as the LSL or LVL is manufactured, any particular thickness, width and length can be selected, but the preferred dimensions disclosed herein approximate those of conventional white oak mats which are in extensive use in the industry. A typical thickness for the mat is approximately 6" to 8", with the central layer providing a thickness of about 1" about 6" and preferably about 2 to about 4" and the upper and lower layers providing a thickness of about 1" to about 3". Of course, the dimensions can vary depending upon the specific end use intended for the mat.

The center layer will be approximately 4 to 8 feet by 12, 14 or 16 feet. The center layer may be made of LSL, LVL or other boards that are oriented perpendicularly to the boards of the top and bottom layers. The number of top, bottom, and center boards will be dictated by the final dimensions of the mat for the particular application or end use. When the center layer is a sheet or plate, the boards of the upper and lower layers can be oriented in the same or a different direction. Generally, for manufacturing simplicity, the boards of these layers are oriented to be parallel or perpendicular to each other. Other more complex angled board arrangements may also be used without departing from the teachings of this invention.

The engineering wood is preferred when close tolerances are required for the core construction. This is primarily necessary for preformed upper and lower encapsulation sections so that the mat can be assembled easily. As noted, after the core construction is placed between the upper and lower sections, the perimeter of those sections is sealed by welding or adhesives.

In a most preferred embodiment, the mat includes a core construction comprising a central layer, an upper layer positioned above the central layer and a lower layer positioned below the central layer, wherein each layer includes a plurality of elongated members of wood or engineered wood having thickness and width dimensions of approximately about 2" by about 8", and with each having a modulus of 1.6 M psi±20% up to about 2 M psi±20% and with the elongated members of the upper and lower layers oriented parallel or perpendicular to each other. Also, the core construction is made of materials that provide a load bearing capacity that is able to withstand a load of at least 600 to 800 psi without damaging or permanently deforming the core construction.

The core construction can include one, two or three layers as desired or necessary for a particular installation. The most preferred construction includes three layers as noted herein.

When elongated members are used for the upper and/or lower layers of the core construction, they provide additional weight to the mat and can be configured in different ways:

a single width construction may be used where eleven 6" wide (by 12' 14' or 16' long) boards are provided in the upper and lower layers with three boards (nos. 3, 6, and 9) in the lower layer offset for interlocking; or a double width construction may be used where four 12" wide (by 12 or 16' long) boards are provided in the upper and lower layers: each one separated by a 6" board with the three 6" boards in the lower layer offset to provide interlocking.

The boards can be made of wood or engineered lumber (preferably with a tolerance of ±1/16") or they can be made of tubes of metal of a thermoplastic or thermosetting material, with pultruded thermosetting tube being one example of a preferred alternative material.

The core constructions may include those made of white oak as disclosed in U.S. Pat. No. 4,462,712 (three layer) and U.S. Pat. No. 5,822,944 (two layer), the entire content of each of which is expressly incorporated herein by reference thereto. Other wood species can be sued as desired. Additional processing of the wood may be required to achieve the desired tolerances for optimum fitting of the construction core when encapsulation pieces are used.

An alternative embodiment relates to the provision of an encapsulation or coating of one or more of the environmentally resistant materials disclosed herein around a sheet, beam or board mat component of wood or engineered wood. The encapsulation or coating is applied prior to the assembly or incorporation of the component into the mat. The encapsulation or coating is applied to all exposed surfaces of the component so that moisture cannot get into the wood and eventually cause deterioration or rotting. The thicknesses would be the same as in other embodiments, namely, about 0.25 to about 0.5 inch or even as thick as about 1 inch or more if desired for particular applications.

In a more general embodiment, the core construction housed within the encapsulation comprises two or three structural layers: a central layer for strength and rigidity; and a layer of elongated members positioned above or below the central layer. Preferably, three layers are present. Suitable materials for the components of the upper, center and/or lower layers of the core construction include any of the materials mentioned in this application. Wood and preferably engineered wood is the most preferred due to the balance of cost and desirable properties, but in addition, metal, thermoplastic and thermosetting materials, and elastomeric materials may instead be used.

Referring now to the Figures, FIG. 1 illustrates mat 100 that includes an upper skin 105 and lower skin 110 which are used to surround and encapsulate core construction 115 and form the encapsulation. The core construction includes a rectangular sheet 120 of wood, plywood, or non-wood material. On the top surface of sheet 120, boards 125 are applied to the sheet 120 by nailing, screwing, bolting or combinations thereof. On the bottom surface of sheet 120, boards 130 are also applied by nailing, screwing or bolting of boards 130 to the sheet 120. Preferably LSL boards are used for the upper and lower boards to obtain a good balance of dimensional tolerance, cost and performance.

When bolting is used, the bolts can extend from the upper boards 125 to the lower boards 130 through the sheet 120. The nails, screws or bolt heads and nuts are recessed below the top surface of boards 125 and below the bottom surface of boards 130 to present relatively smooth upper and lower surfaces of the core construction 115.

Alternatively, the boards can be attached to the sheet 120 by an adhesive or other means that provide a secure attachment. For example, when the core construction is made of a thermosetting material, the sheet and boards can be made of the same material in a unitary component. The same is true of a welded metal core construction.

A first embodiment of the invention is shown in FIGS. 1-4, where the encapsulation comprises two thermoplastic skins forming upper and lower portions of the mat surrounding a core construction made of wood boards.

As shown in FIG. 1, eight (8) boards are used, with each two board pair separated by a space that would accommodate another board. Both the upper and lower boards that are attached to the sheet 120 are arranged in the same way so that the same size skin portions can be used to encapsulate the top and bottom of the core, thus allowing a single mold to provide moldings that can be used as either the upper or lower skin portions.

Spaces are provided for the third, sixth, and ninth boards (135, 140, 145, respectively) of the upper portion of the mat to allow such boards to be applied to the skin portions after encapsulation of the core construction 115. Also, space is provided for the third sixth and ninth boards (155, 160, 165, respectively) of the lower portion of the mat to allow interlocking of the mat to an adjacent mat. The boards 155, 160 and 165 are applied to the lower skin portion in order to extend outwardly from the end of the mat to be received in a space in the lower skin of an adjacent mat. Although these additional boards are attached to the mat by screwing or bolting, any holes made through the skin are also sealed to prevent introduction of water or moisture into the core construction.

Lifting elements 150 are provided on the third and ninth boards of the upper skin portion. These lifting elements 150 are configured as D shaped rings which are attached to the boards in recesses 170 so that the lifting element 150 can remain flat when the mat 100 is in use. Two lifting elements are shown but a skilled artisan can determine how many elements are needed for lifting of any particularly sized mat. If desired, lifting elements can also be provided on the boards attached to the lower skin portion 110 for versatility in the handling and transportation of the mat. The lifting elements are provided on the boards that are attached to the skin portion so that if the lifting elements or boards are damaged they can be easily removed and replaced.

The provision of single width boards enables the upper and lower moldings to have water channels 175 on the upper surface of the skin to drain water from the mat.

Figure 2:
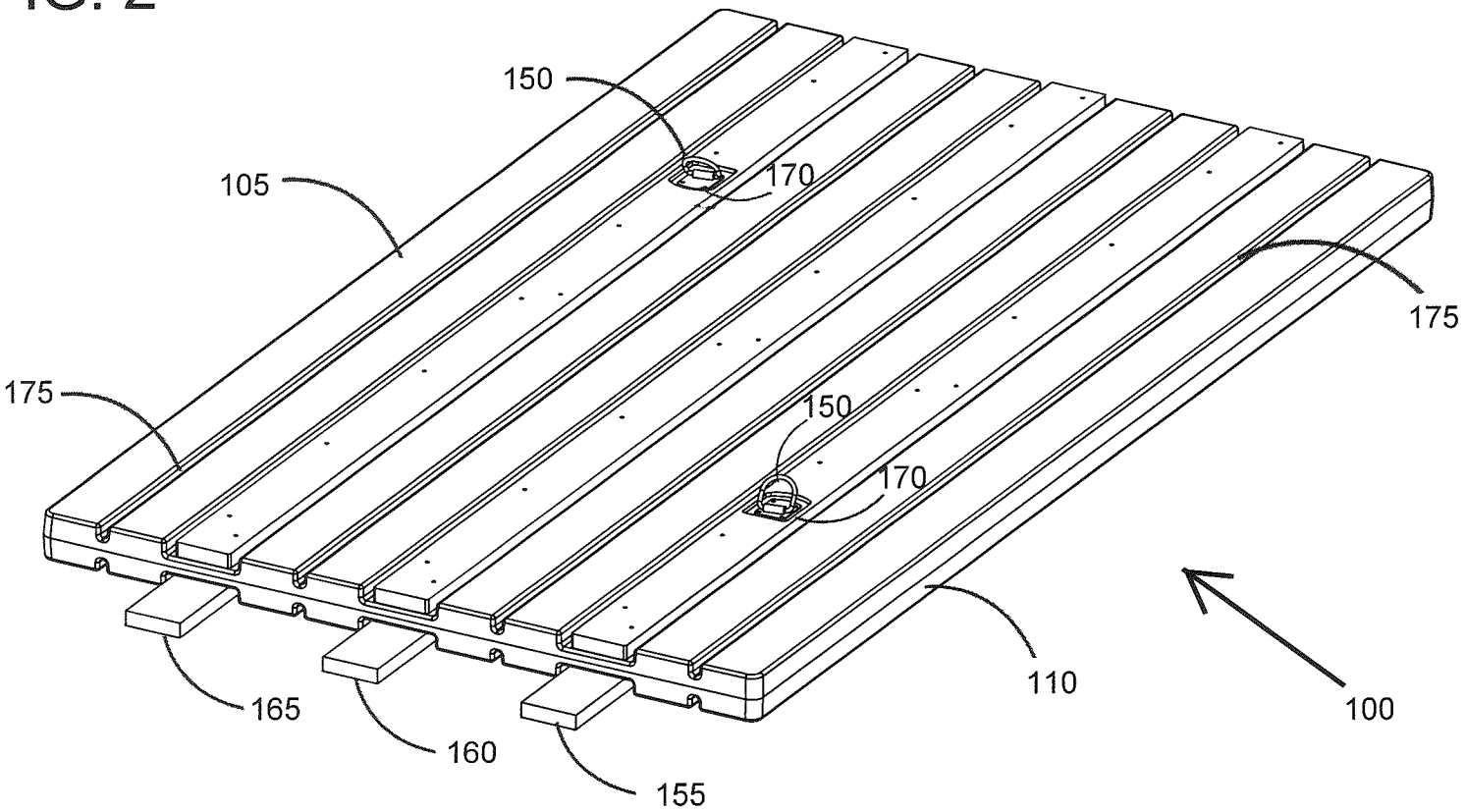
FIG. 2 is a view of the assembled mat of FIG. 1.

FIG. 2 illustrates the final shape and configuration of the mat 100 after assembly.

Figure 3:
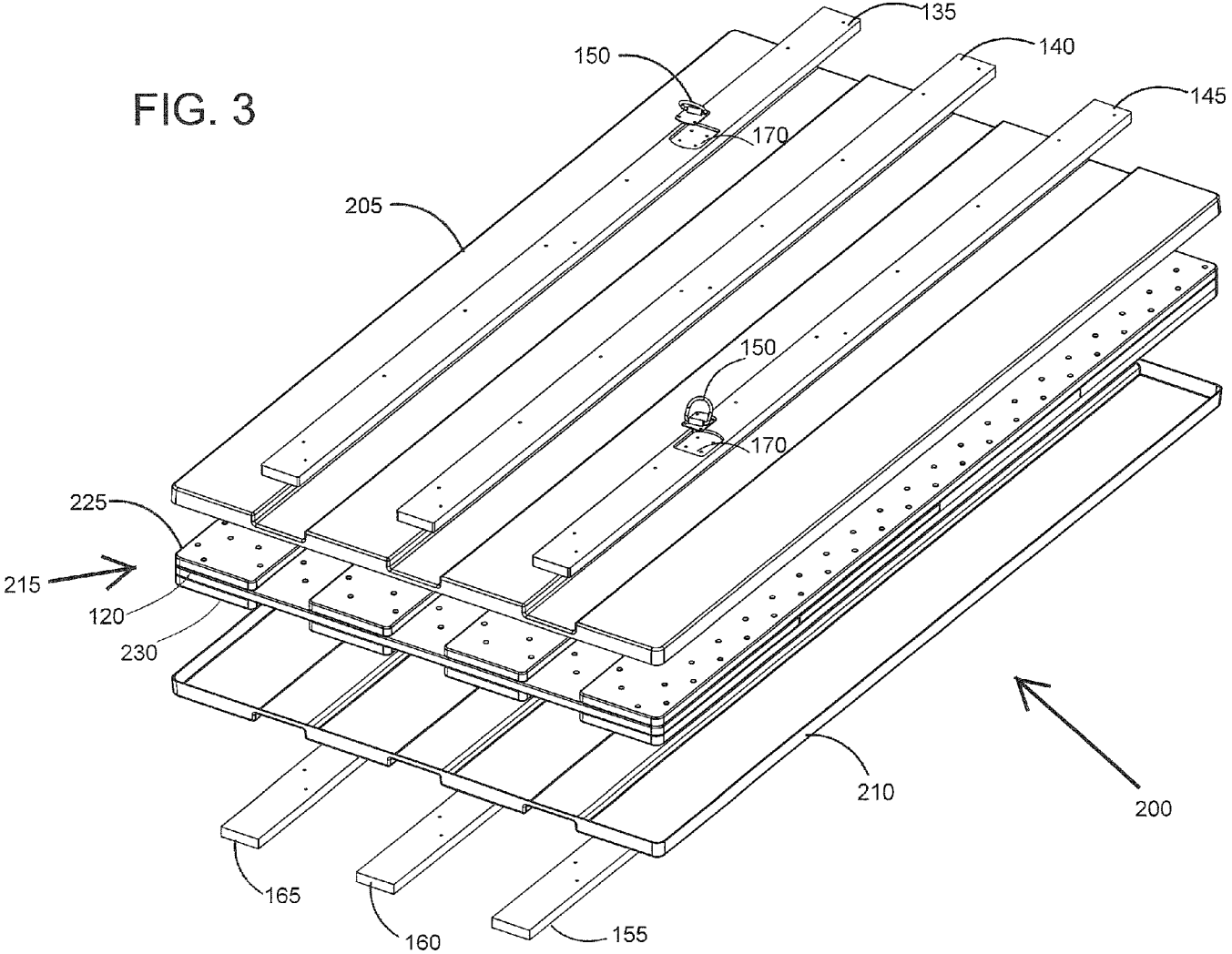
FIG. 3 is an exploded view of a mat according to the invention showing the use of double width boards for the upper and lower layers, and a core construction that is encapsulated.

FIG. 3 illustrates a second mat 200 according to the invention. In this mat, double width boards 225, 230 are used in place of the single width boards 125, 130 of FIG. 1. This results in upper 205 and lower 210 skin portions that have a wider molded segments to accommodate the double width boards. As in the embodiment for FIG. 1, space is provided for the additional boards that include the lifting elements and that provide interlocking. As a number of the same components are used, the same numerals used in FIG. 1 are used to designate the same components for the mat of FIG. 3.

Figure 4:
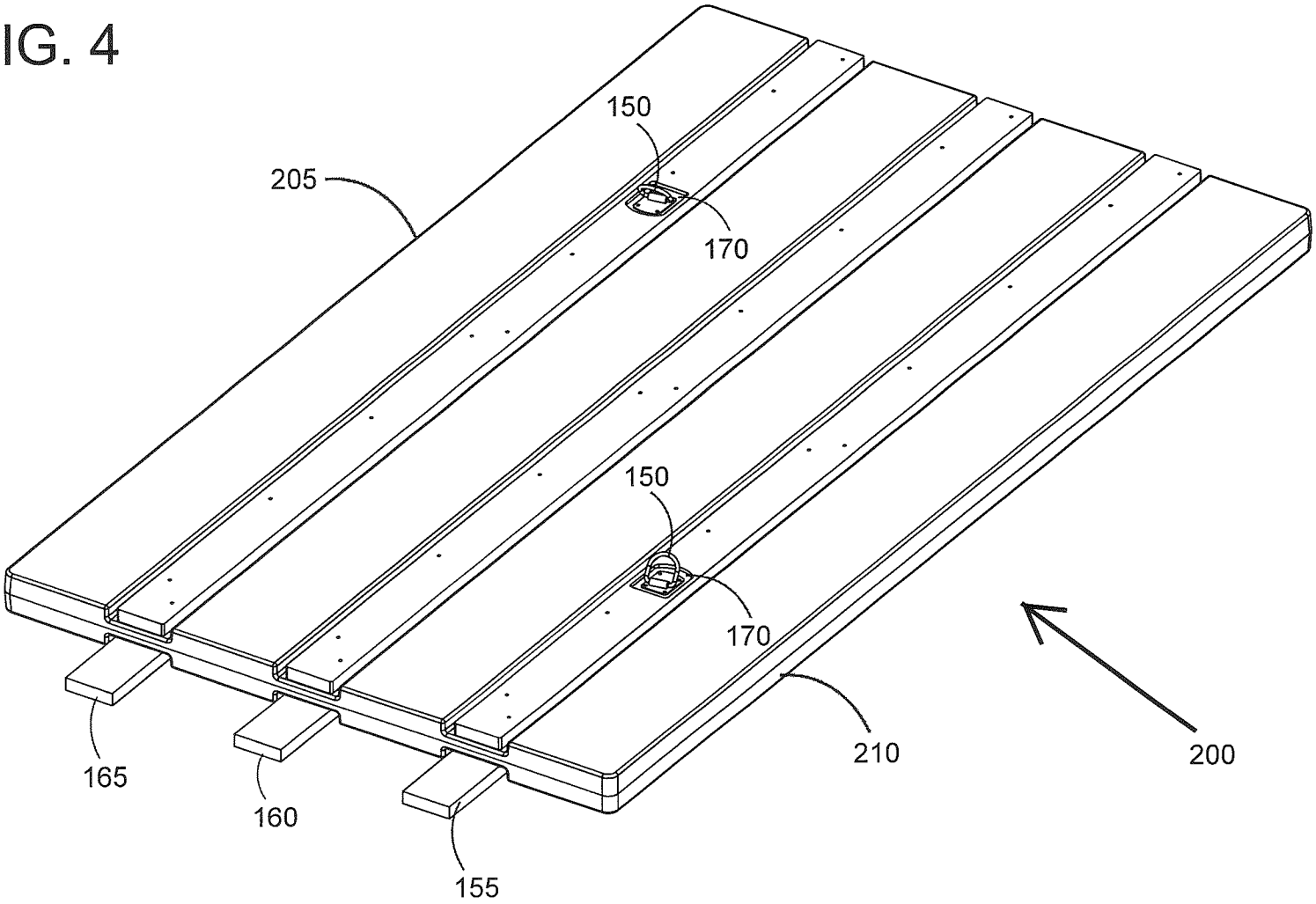
FIG. 4 is a view of the assembled mat of FIG. 3.

FIG. 4 illustrates the final mat 200 after assembly.

The drainage channels 175 provide an advantage for mat 100 compared to mat 200 when the mats are to be used in an environment that will experience rainy or snowy weather conditions. For application of the mats in a dry environment, mat 200 is preferred because it is easier to manufacture.

Figure 5:
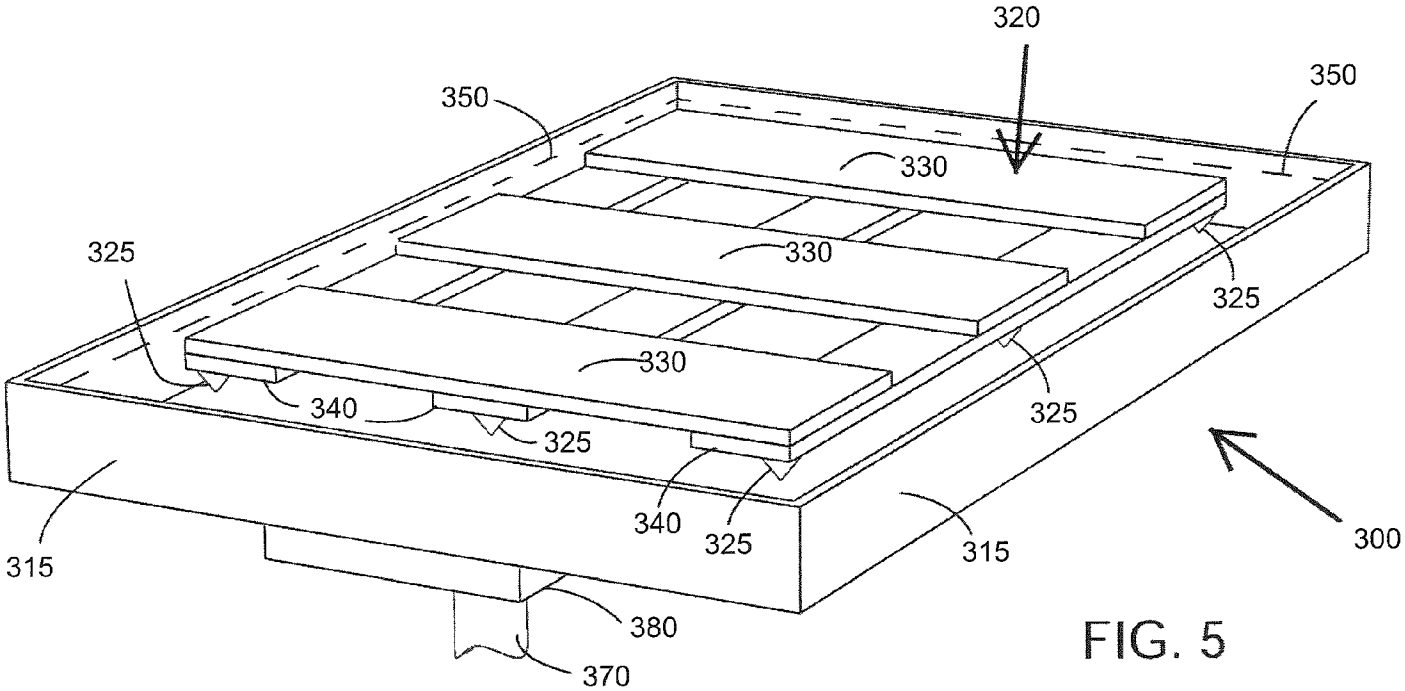
FIG. 5 is a perspective view of a mold that is holding the frame construction therein prior to receiving plastic material to form a mat.

An additional embodiment is illustrated in FIGS. 5-8, wherein a wood mat is suspended in a tank or mold that receives polymer material that encapsulates the mat. FIG. 5 is a perspective view of a mold 300 that is used for holding a mat frame construction 320 therein prior to receiving plastic material and forming the encapsulated mat. The mold 300 includes sides 315, a base and an open top in the form of a rectangle that has a slightly greater perimeter than that of the frame construction 320. The frame construction 320 is supported in the mold by a number of inverted cones 325 that raise the frame construction 320 above the base of the mold by a distance that corresponds to the thickness of the plastic encapsulation. Also, the frame construction 320 is spaced from the sides 315 of the mold by the same distance. As noted herein, the mold and frame construction are configured with dimensions that provide a clearance of 0.25 to 1" about the frame construction.

To form the encapsulated mat, a liquid plastic material is filled into the mold 300 to surround the mat and fill any interstices between the boards of the frame construction 320. As disclosed herein, the plastic may be a molten thermoplastic or a catalyzed liquid thermosetting resin. To achieve the desired thickness of the encapsulation on the upper side of the mat, a fill line 350 is provided. The added plastic material is then allowed to cool or harden to form the mat 360.

A hydraulic lifting member 370 and support pad 380 are provided beneath the base of the mold to lift the base upwards after the mat is cooled. The base is removably associated with the sides 315 in a way that retains the liquid plastic therein when forming the mold and then which allows the lifting member to raise the formed mat above the sides for ejection and recovery of the final mat. As noted herein, the inner sides of the mat can be provided with a film that does not adhere or only slightly adheres to the surfaces of the mold so that the mat can be lifted easily after formation.

Figure 6:
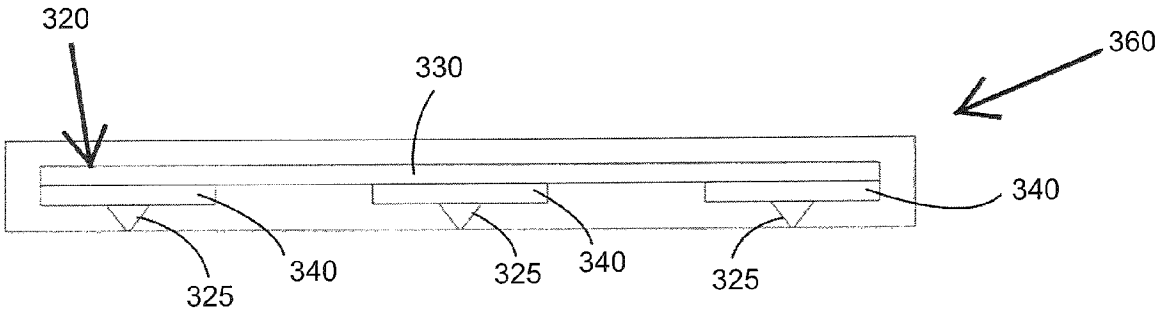
FIG. 6 is a cross sectional view of the mat after removal from the mold of FIG. 5.

FIG. 6 is a cross sectional view of the mat 360 after it is formed and removed from the mold of FIG. 5. The mat 360 has a relatively uniform thickness around the frame construction 320 such that the frame construction 320 is protected from the elements during use. This enables a frame construction made of wood to provide a much longer service time than if the wood was exposed to water or moisture which over time can cause the wood to rot or degrade.

Figure 7:
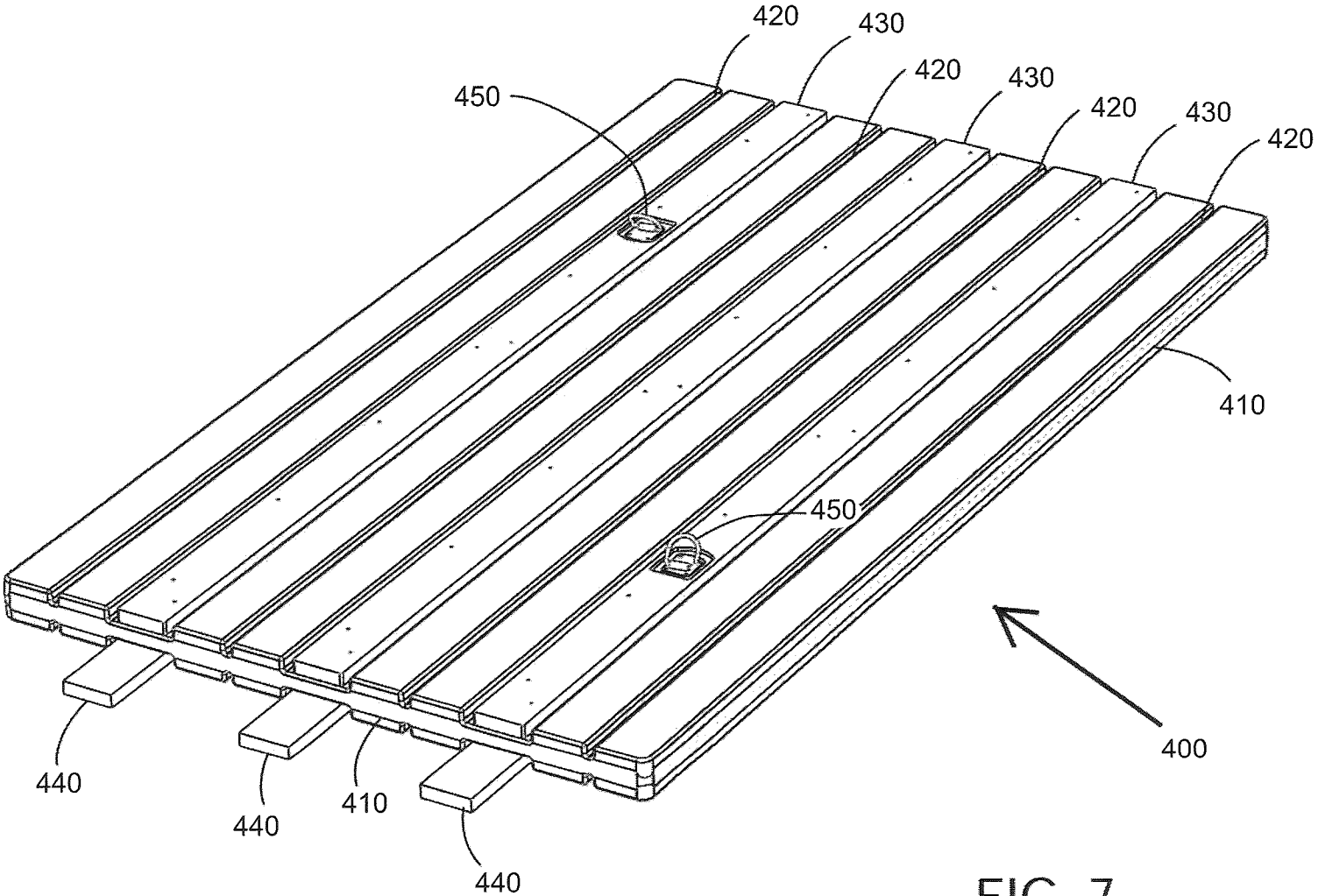
FIG. 7 is a view of an encapsulated mat that includes single width boards.

FIG. 7 is a view of an encapsulated mat 400 that includes single width boards. The mat includes encapsulation 410 which surrounds all internal boards of the frame construction that provides strength to the mat. The encapsulation 410 is formed with a number of longitudinal recesses 420 that run the length of the mat to provide allow drainage of moisture from the surface of the mat during use. Larger recesses are provided for the attachment of boards 430. On the upper surface of the mat, boards 430 complete the upper surface to provide a flat, weight bearing arrangement. Some of these boards 430 may be provided with lifting elements 450 to allow lifting or moving of the mat. These boards 430 are attached to the encapsulated structure by nails, screws or rivets. Alternatively, these boards 430 may be bolted to the mat after drilling holes therethrough to receive the bolts. Appropriate nuts or other fasteners can be provided as needed.

On the lower surface of the mat, boards 440 are provided. These boards are offset to allow interlocking of one mat to an adjacent mat. At one end of the mat 400, the ends of boards 440 extend beyond the end of the mat as shown. On the opposite end of the mat, the recesses are open by the same length as the stick out portion of the boards 440 on the opposite side in order to receive board ends from an adjacent mat. Boards 440 are also attached to the mat by nails or screws, or they can be bolted to the mat in the same way or in conjunction with the attachment of boards 430.

Figure 8:
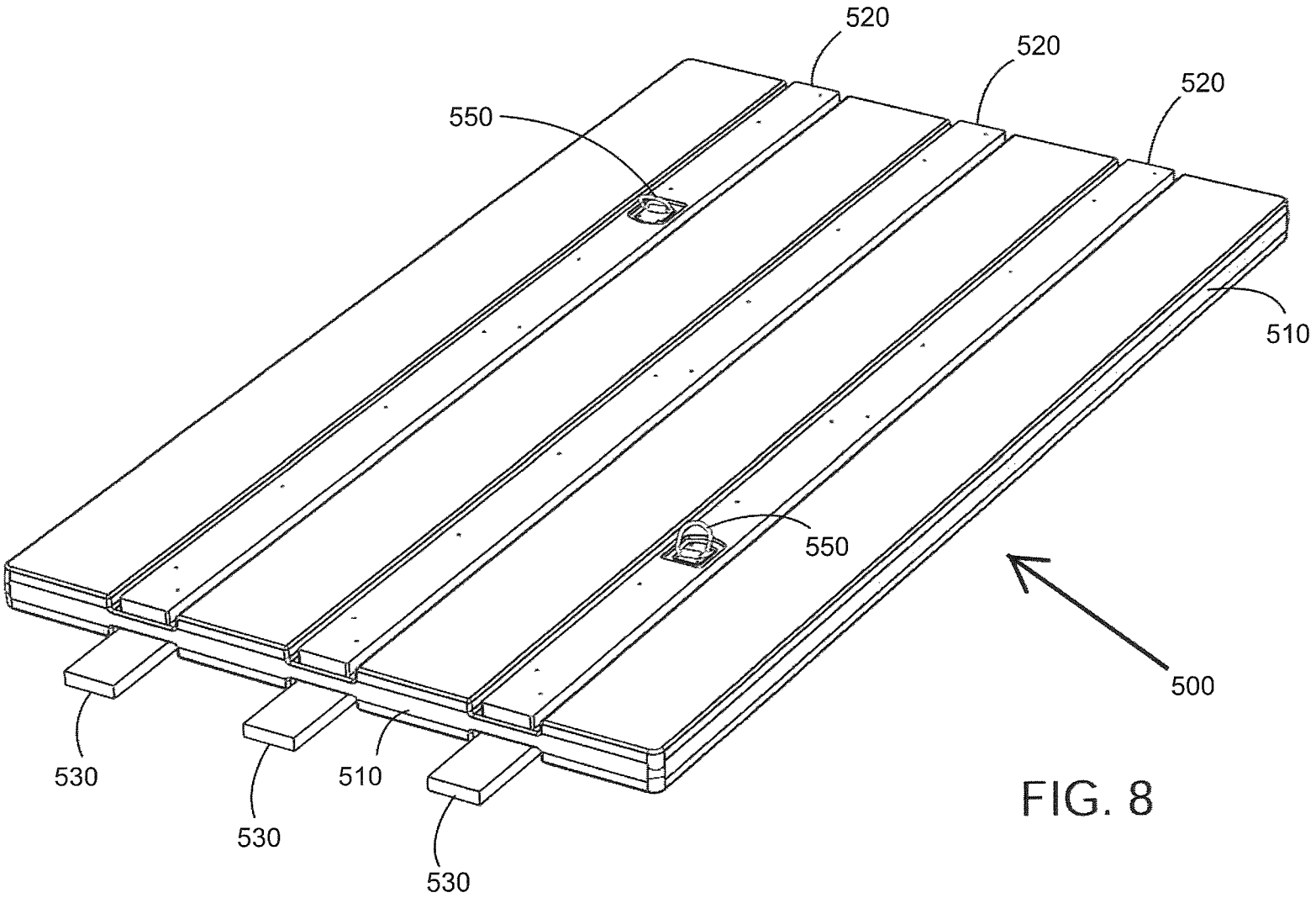
FIG. 8 is a view of an encapsulated mat that includes double width boards.

FIG. 8 is a view of an encapsulated mat 500 that includes double width boards. The mat includes encapsulation 510 which surrounds all internal boards of the frame construction that provides strength to the mat. The encapsulation 510 is formed with a number of longitudinal recesses that are provided for the attachment of boards 520. On the upper surface of the mat, boards 520 complete the upper surface to provide a flat, weight bearing arrangement. Some of these boards 520 may be provided with lifting elements 550 to allow lifting or moving of the mat. These boards 520 are attached to the encapsulated structure by nails, screws or rivets. Alternatively, these boards 520 may be bolted to the mat after drilling holes therethrough to receive the bolts. Appropriate nuts or other fasteners can be provided as well.

On the lower surface of the mat, boards 530 are provided. These boards are offset to allow interlocking of one mat to an adjacent mat. At one end of the mat 500, the ends of boards 530 extend beyond the end of the mat as shown. On the opposite end of the mat, the recesses are open by the same length as the stick out portion of the boards 530 on the opposite side in order to receive board ends from an adjacent mat. Boards 530 are also attached to the mat by nails or screws, or they can be bolted to the mat in the same way or in conjunction with the attachment of boards 520.

To form the recesses on the mats 400, 500 of FIGS. 7 and 8, the mold base is provided with a non-uniform raised surface that corresponds to the shape and position of the recesses of the mat. This provides the recesses in the lower surface of the mat. On the upper surface of the mat, a lid is provided which is also configured with a non-uniform raised surface that corresponds to the shape and position of the recesses for the top surface of the mat. The mold lid is placed on the liquid plastic after the mold is filled. The lid surface is also provided with a plastic film so that the mat encapsulation does not stick to it after formation of the mat.

The encapsulation protects the frame construction from degradation due to weather conditions, typically moisture or water from rain or snow, as well as contact with oil, gas or other chemicals. If the mats are to be used in a particular chemical environment, the plastic materials can be selected for optimum resistance against that environment. Generally, however, the plastic material is one that can provide water and moisture resistance for the wood materials that are used for the frame construction. Also, the plastic material shall be chemically resistant to typical liquids found in the construction site. Thus, the mat will not absorb water or other liquid contaminates so that after cleaning or washing, the mat can be removed from the work site without transporting the liquid contaminates.

While the encapsulation provides a unitary structure, in use it is envisioned that the encapsulation may eventually experience damage due to handling, installation and use in supporting heavy equipment or vehicles. In some cases it will be possible to patch or otherwise repair the damaged areas while still retaining a sealed structure that will resist moisture penetration. In some cases, however, it will be necessary to completely remove the damaged encapsulation such that a knife or hot wire can be used to cut through an encapsulation of a thermoplastic material for complete removal and replacement when necessary to remediate damaged encapsulation material.

As mats are generally designed with water channels on the upper and lower surfaces or layers to drain water from the mat, the molds are typically configured with the same design to achieve that purpose. Accordingly, the upper and lower surfaces of the encapsulation are not flat but instead are configured to match the surface provided by the frame construction. The provision of the same design on the top and bottom surfaces of the mats allows the top surface to receive boards to complete the surface and the bottom surface to receive the interlocking boards, which in effect are the same boards that are used on the top except that they are offset by 6" or so to allow interlocking with an adjacent mat.

The boards can be attached to the mat using self-tapping lag screws or rivets. As the frame construction is precisely positioned in the mold, the points where the boards intersect is known. Thus, the interlocking boards can be attached to the mat by screwing or riveting into the frame construction. And as noted herein, if other frame constructions including those made of fiberglass reinforced plastic are used, the interlocking boards can be attached in the same manner. If the frame construction is made of metal, it can be provided with bolting extending therefrom towards the top and bottom surfaces of the mat in the recesses to allow attachment of boards that are provided with holes to receive the bolts. The boards can then be secured to the mats using appropriate nuts and washers that engage the threaded ends of the bolts.

For any of the frame constructions disclosed herein, the weight of the mat can be controlled by the provision of particulate material therein. For example, a screen or mesh can be placed in the frame construction so that particulate material can be added and retained therein prior to the addition of the plastic material into the frame structure. This combination provides further benefits to the mat, including greater stiffness, strength, and control of the weight, either higher or lower depending upon the intended application of the mat.

Figure 9:
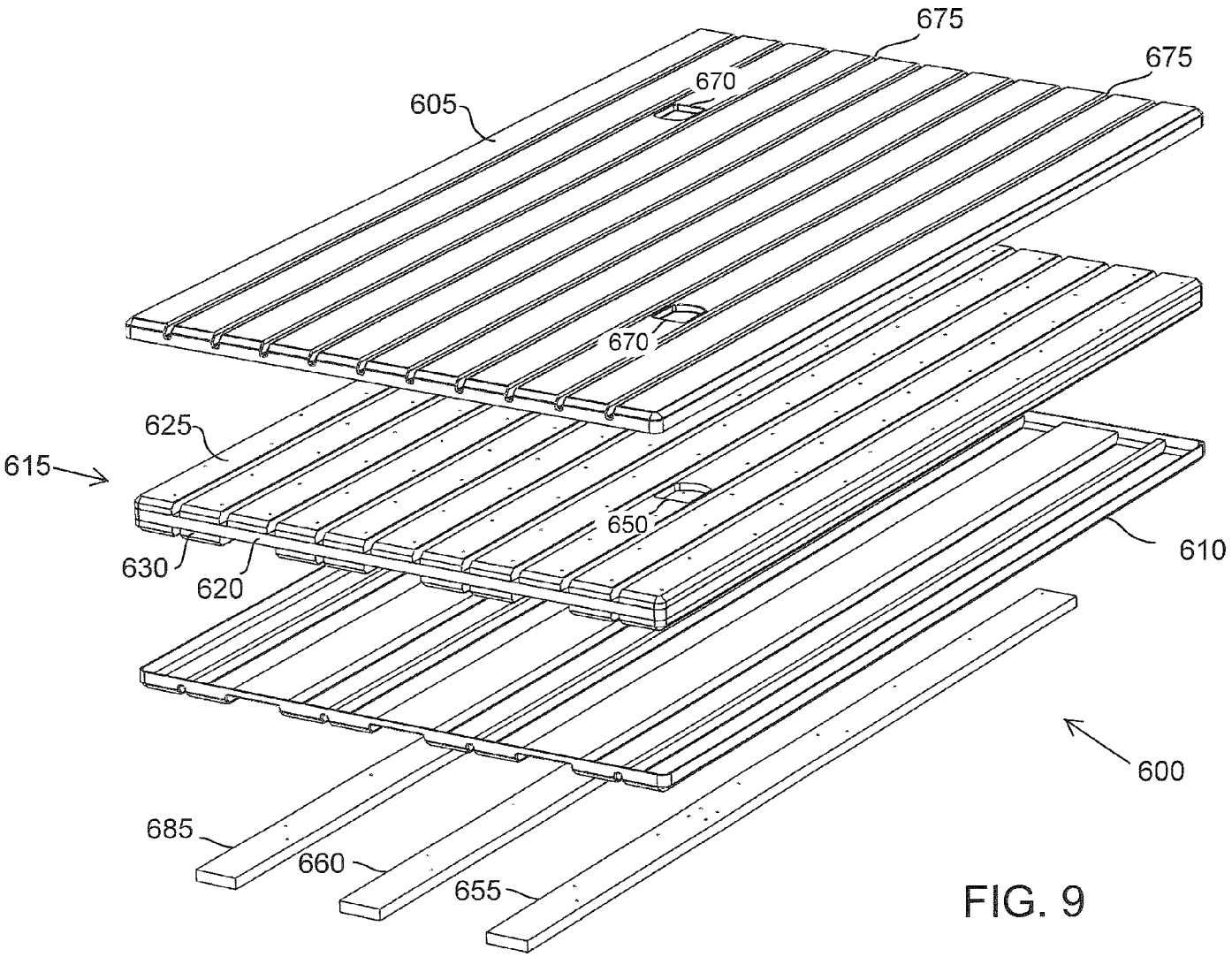
FIG. 9 is an exploded view of the mat of the invention showing the use of single width boards for the core construction including the central, upper and lower layers, with the encapsulation artificially separated into upper and lower portions to illustrate its position about the core construction.

FIGS. 9-17 illustrate another encapsulated mat, this one having an encapsulation of crumb rubber particles in a polyurethane matrix. FIG. 9 is an exploded view of an encapsulated mat 600 that shows the encapsulation in two artificial sections, namely an upper portion 605 and lower portion 610 which are used to surround and encapsulate core construction 615. Of course, the encapsulation is applied to completely surround the core construction but is shown herein as cut and separated so that the core construction 615 can be seen. The core construction may instead include a rectangular sheet 620 of wood, plywood, engineered wood, or a non-wood material such as a thermosetting resin or a metal. On the top surface of sheet 620, boards 625 are applied to the sheet 620 by nailing, screwing, bolting, adhesives or combinations thereof. On the bottom surface of sheet 620, boards 630 are also applied by nailing, screwing, bolting or adhesive joining of boards 630 to the sheet 620.

Preferably hardwood or LSL boards are used for the core construction with LSL used for the upper and lower boards to obtain a good balance of dimensional tolerance, cost and performance. Of course, hardwood can be used throughout for the lowest cost construction. When bolting is used, the bolts can extend from the upper boards 625 to the lower boards 630 through the sheet 620. The nails, screws or bolt heads and nuts are recessed below the top surface of boards 625 and below the bottom surface of boards 630 to present relatively smooth upper and lower surfaces of the core construction 615.

Alternatively, the boards can be attached to the sheet 620 by an adhesive or other means that provide a secure attachment. This allows wood boards to be used with a metal or FRP central layer. When the core construction is made of a thermosetting material, the sheet and boards can instead be made of the same material to form a unitary support structure. The same is true of a welded metal core construction. These materials can be mixed or matched depending upon the intended use of the mat. As noted, this preferably includes:

(a) One or more layers of engineered wood not less than about 1 inch nor more than about 12 inches thick;

(b) A grating material of a thermosetting plastic material of a polyester, epoxy or the others mentioned herein. The thermoset material may be reinforced with fiberglass, carbon, etc. Or it may be an unreinforced engineered polymer. Glass fiber reinforcement in an amount of about 50 to about 75% provides a high stiffness to the support structure. Preferably, the grating would be between about 2 and about 4" thick to provide sufficient strength for the core construction at a relatively low weight for the mat;

(c) A thermosetting plastic material in the form of pultruded rods. These can be of solid or hollow tubular construction and are preferably square or rectangular in cross section. If desired, the openings can be filled with form or particulate matter; or (d) Any type of metal in whatever thickness is necessary, with steel being the most economical.

For the preferred wood mats, as shown in FIG. 9, eight (8) boards are again used, with each two board pair separated by a space that would accommodate another board for interlocking of the mat with an adjacent mat. Both the upper and lower boards that are attached to the sheet 120 are arranged in the same way so that the same size mold portions can be used to form the encapsulation on the top and bottom surfaces of the core construction. Alternatively, the upper surface of the core construction can be provided with boards in the spaces so that the interlocking boards are provided only on the lower surface of the mat. For this, the upper mold part would be configured differently from the lower mold part.

As shown, spaces are provided for the third, sixth, and ninth boards (655, 660, 665, respectively) of the lower portion of the construction core 615 to allow such boards to be applied to the encapsulation of the core construction 615 to thus allow interlocking of the mat to an adjacent mat. The boards 655, 660 and 665 are applied to the encapsulation in order to extend outwardly from the end of the mat to be received in a space in the encapsulation of an adjacent mat. Although these additional boards are attached to the mat by screwing or bolting, any holes made through the encapsulation are also sealed or provided with O-rings to prevent introduction of water or moisture into the wood components or members of the core construction and degradation of the wood over time.

Openings 670 for receiving lifting elements are provided on the encapsulation upper surface 605. These lifting elements may be configured as D shaped rings which are attached to the boards in recesses 670 so that the lifting element can remain flat when the mat 600 is in use. Two openings for lifting elements are shown but a skilled artisan can determine how many elements are needed for lifting of any particularly sized mat. If desired, openings can be provided for lifting elements to be installed on the boards attached to the lower surface of the mat for versatility in the handling and transportation. The lifting elements are provided on the boards that are attached to the encapsulation so that if the lifting elements or boards are damaged they can be easily removed and replaced.

The provision of single width boards enables the upper and lower moldings to have water channels 675 on the upper surface of the encapsulation to drain water from the mat.

Figure 10:
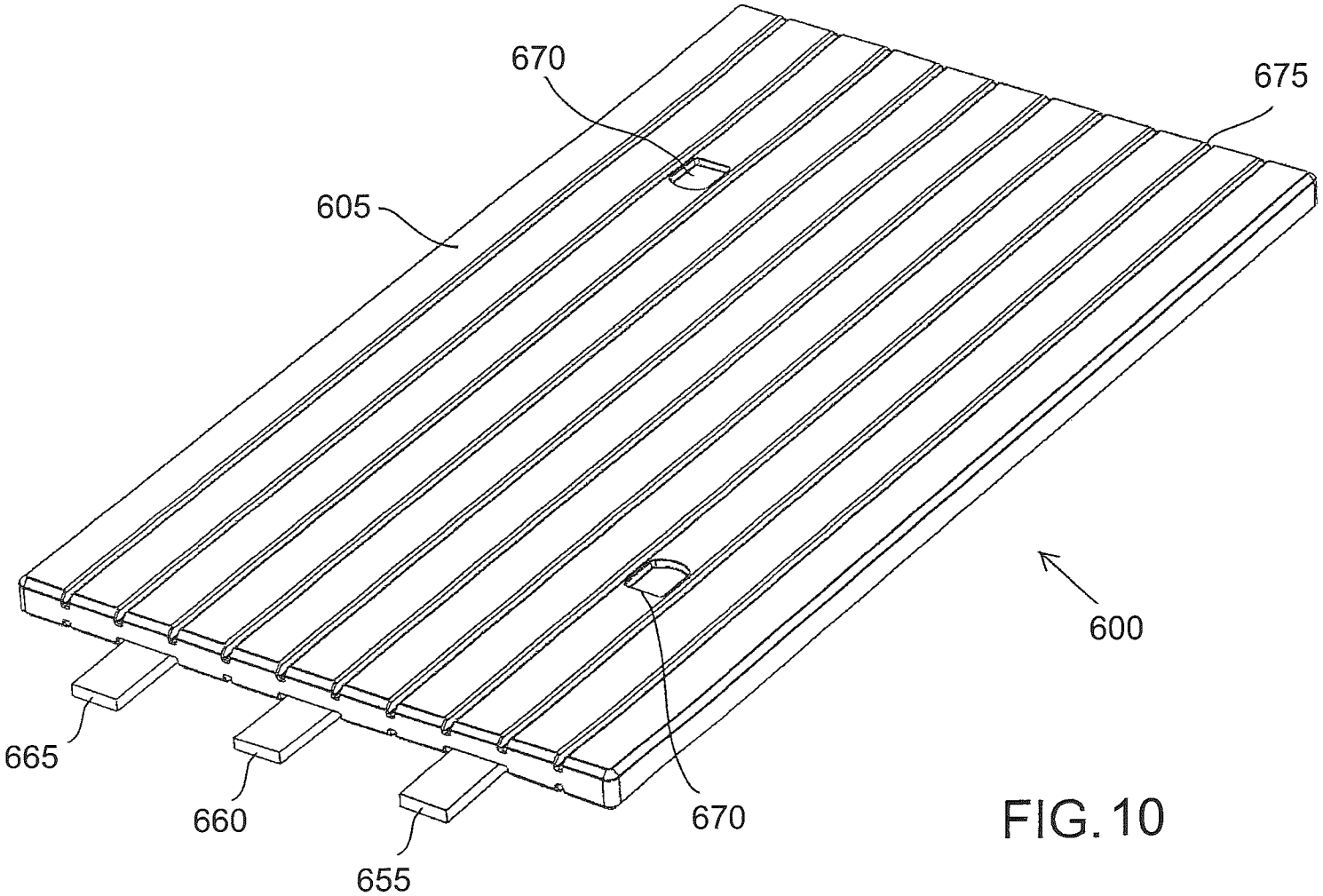
FIG. 10 is a top perspective view of the mat of FIG. 9 as prepared for use.
Figure 11:
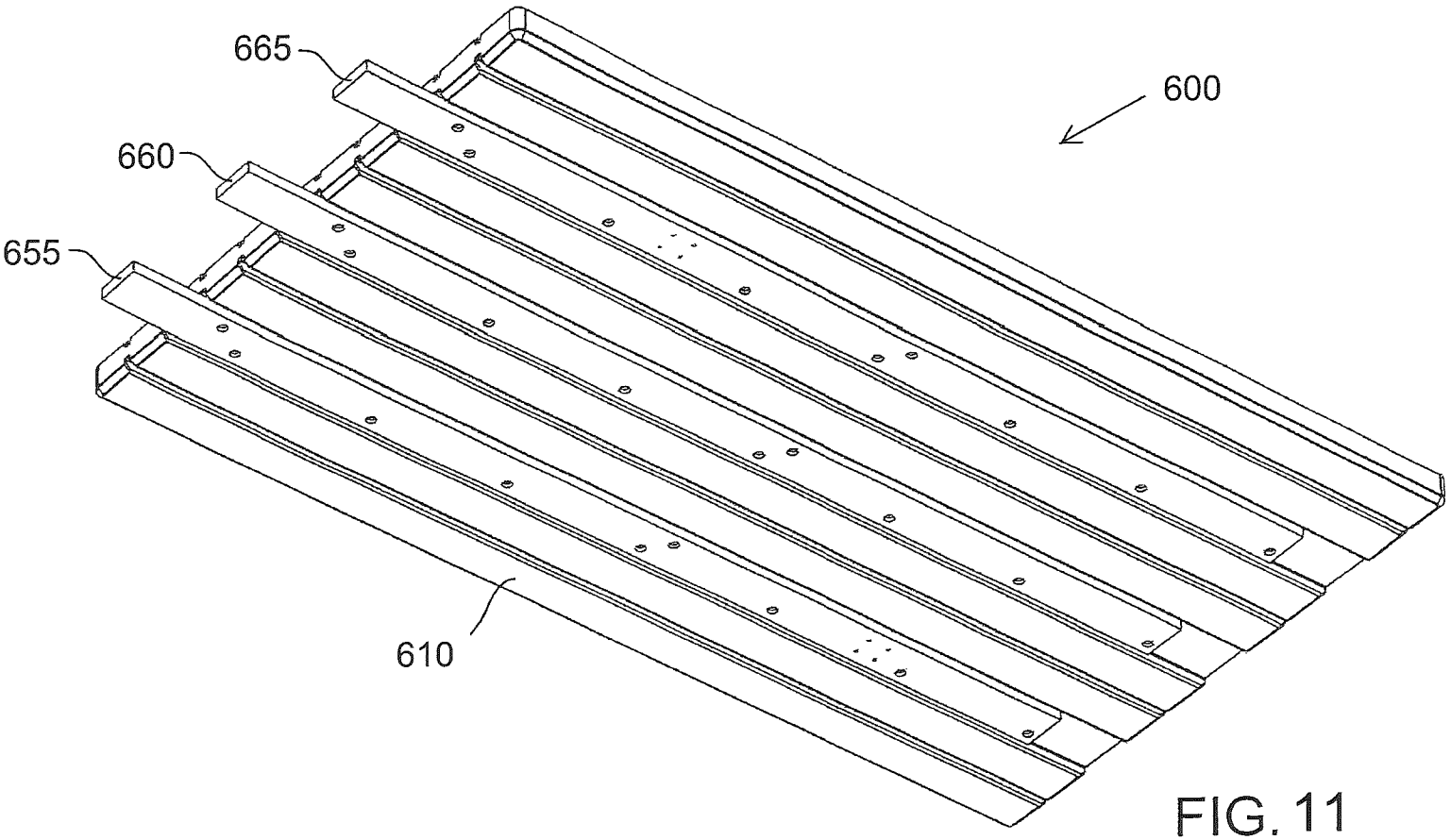
FIG. 11 is a bottom perspective view of the mat of FIG. 9 as prepared for use.

FIGS. 10 and 11 illustrate the final shape and configuration of the mat 600 after assembly. The encapsulation covers the entire mat with the exception of the three interlocking boards 655, 660, 665 on the bottom surface that are added after the core construction is encapsulated.

Figure 12:
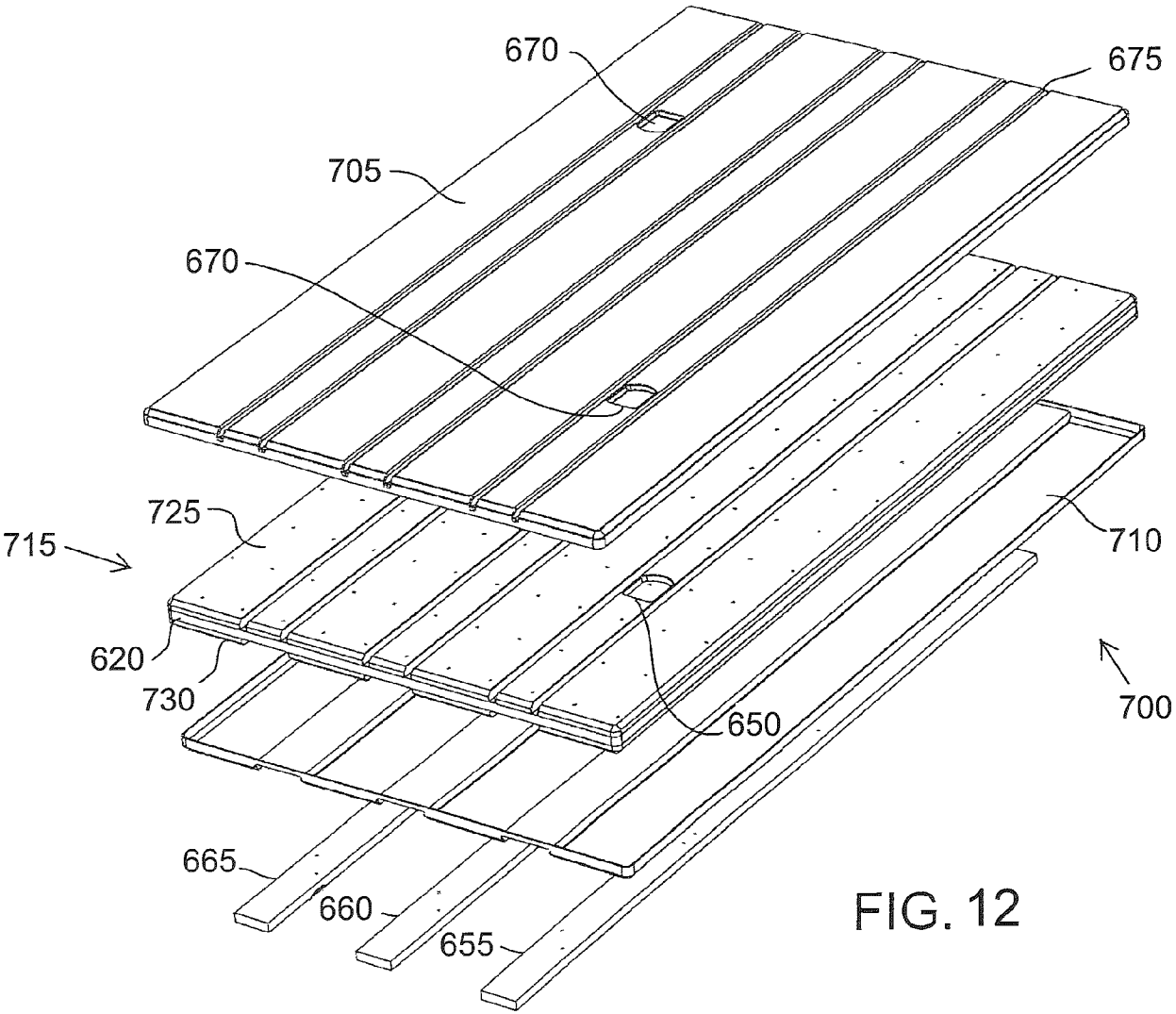
FIG. 12 is an exploded view of a mat according to the invention showing the use of double width boards for the core construction including the central, upper and lower layers, with the encapsulation artificially separated into upper and lower portions to illustrate its position about the core construction.

FIG. 12 illustrates a second mat 700 according to the invention that uses three layers of wood for the core construction. In this mat, double width boards 725, 730 are used in place of the single width boards 625, 630 of FIG. 9. As in FIG. 9, the encapsulation is shown in two artificial sections, namely an upper portion 705 and lower portion 710 which are used to surround and encapsulate core construction 715. As in the embodiment for FIG. 9, space is provided for the boards 655, 660, 665 on the lower portion 710 of the encapsulation that provide interlocking and openings 670 are provided for attachment of lifting elements. Openings 650 may also be provided on the boards of the core construction 715 beneath openings 670 of the encapsulation so that the lifting elements can be directly attached to the core construction 715. As a number of the same components are used, the same numerals used in FIGS. 9-11 are used to designate the same components for the mat of FIGS. 12-14.

Figure 13:
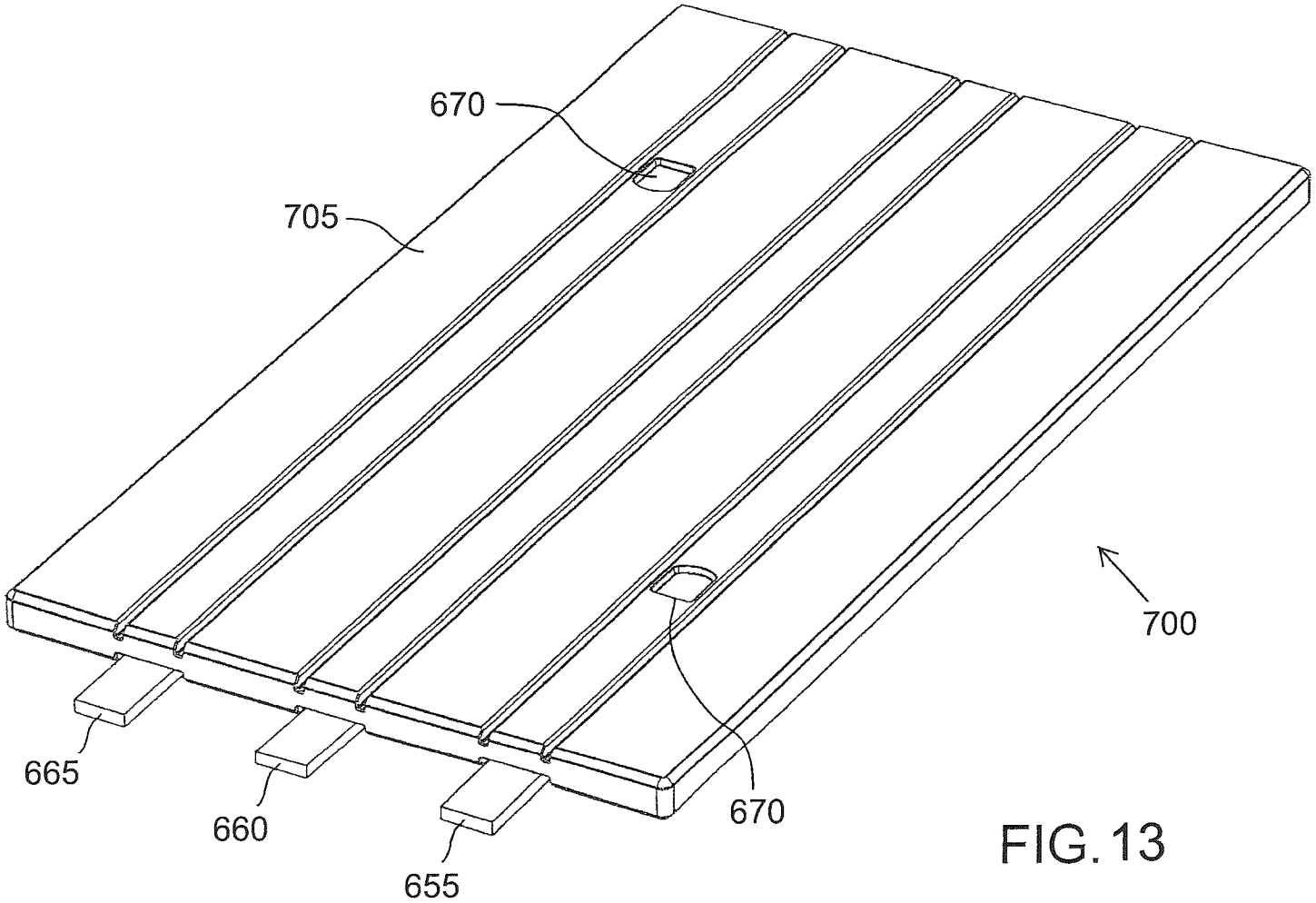
FIG. 13 is a top perspective view of the mat of FIG. 12 as prepared for use.
Figure 14:
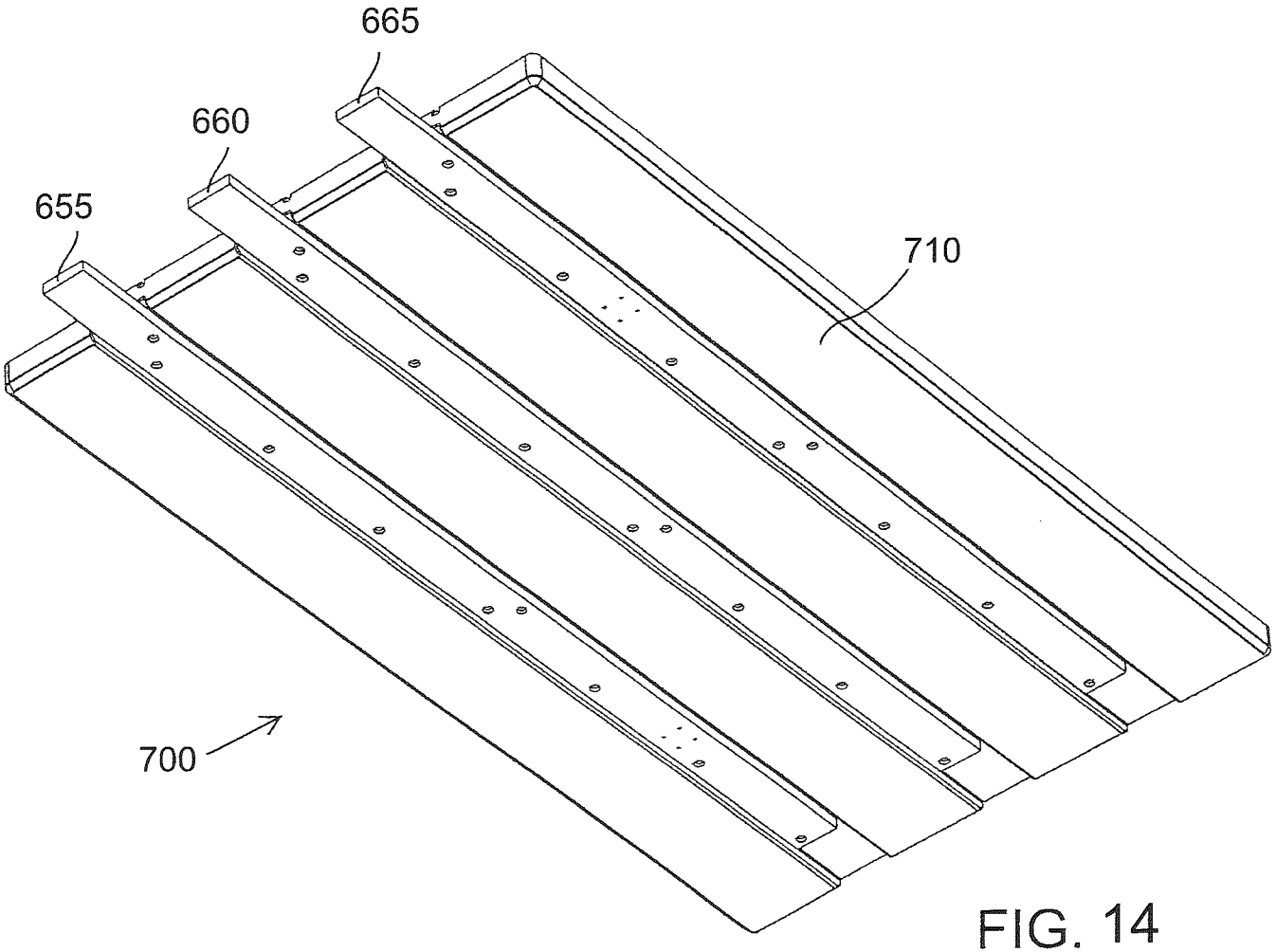
FIG. 14 is a bottom perspective view of the mat of FIG. 12 as prepared for use.

FIGS. 12-14 illustrate the final mat 700 after assembly. The drainage channels 675 provide an advantage when the mats are to be used in an environment that will experience rainy or snowy weather conditions. These channels are provided by including projections or protruding segments on the mold. For application of the mats in a dry environment, these can be optional although they are preferred since the mats are often used in wet environments.

And while offsetting of certain boards is shown for providing an interlocking with adjacent mats, this is not always needed such that interlocking can be considered to be an optional yet desirable feature. Interlocking is often preferred to avoid staking of the mats to the ground or to avoid including other more complex components for use in connecting adjacent mats together. The interlocking boards are provided on at least the lower surface of the mat, but in certain embodiments, they can be provided on both the lower and upper surfaces of the mat as shown in the figures. And interlocking boards can be entirely omitted if desired, with the core construction including boards in all spaces prior to being encapsulated.

Figure 15:
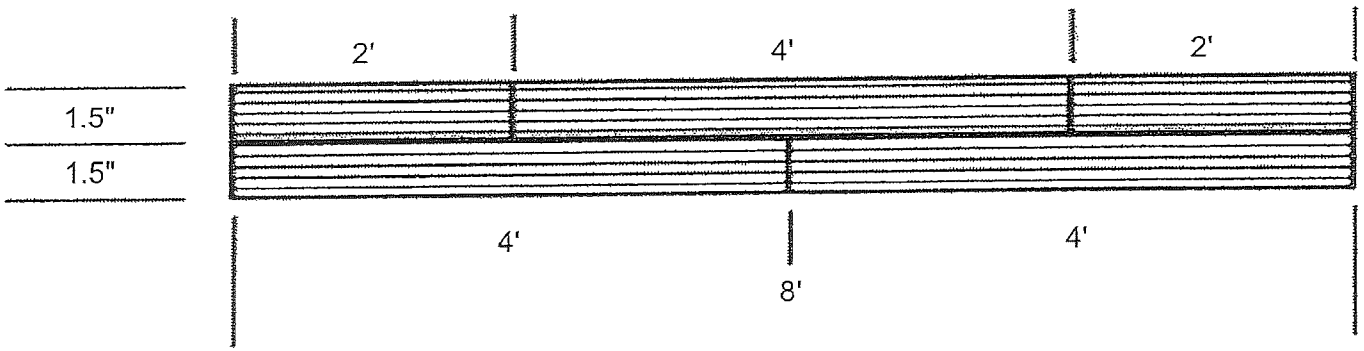
FIG. 15 is a schematic illustration of an engineered wood configuration for use as the core construction.

When engineered lumber is used, there are a number of configurations which are ideally suited for use of that material as the core construction of the present invention. In particular, LVL is used for these embodiments. A preferred embodiment is shown in FIG. 15, wherein the structure of the core construction is a 3 inch thick, 4 foot wide by 8 foot long block that is made by multiple strips of unidirectional veneers that are adhered together to form the block. First of all, two base blocks that are 1.5 inches thick and are 4 foot wide by 4 foot long are prepared. These blocks are joined together along their width to form a 4 foot by 8 foot by 1.5 inch thick combined block structure. This combined block structure is reinforced by adding two 1.5 inch thick, 4 foot wide by 2 foot long sections on the upper surface of the combined block structure: one at the forward end of the mat and one at the rear end of the mat. Between these sections is a middle section that is 1.5 inch thick, 4 foot wide and 4 foot long located between the forward and rear sections.

For greatest strength in any of these embodiments, most unidirectional veneers are oriented in the machine direction with 5 to 30% and preferably 20 to 25% of the veneers oriented in the cross machine direction. That geometry sets up some very impressive physicals for the combined structures.

The structure shown in FIG. 15 is a "single board" that would require no fastening mechanisms and that can be just dropped onto the bed of rubber crumbs in the mold. Furthermore, the costs of the structures of these embodiments will be on the order of oak or other hardwoods.

Preferred overall mat dimensions for wood mats are approximately 8' wide×6" tall and are either 12 ft, 14 ft or 16 ft in length. The interlocking feature will extend the length of the mats by about 1 ft at three locations at one end of mat. As noted, U.S. Pat. No. 4,462,712 discloses mats which contain interlocking fingers and recesses which are preferred for use in the present invention. The mats typically include three (3) layers of individual wood or engineered wood boards having cross section dimensions of 1.75" by 8".

The spacing between individual boards or components in the upper layer is preferably approximately 1.25" to allow water to drain from the mat. This spacing is retained in the encapsulation. The slip resistance of the mat is improved by the draining of the excess water, especially when use in locations that experience heavy rain or snow conditions.

Figure 16:
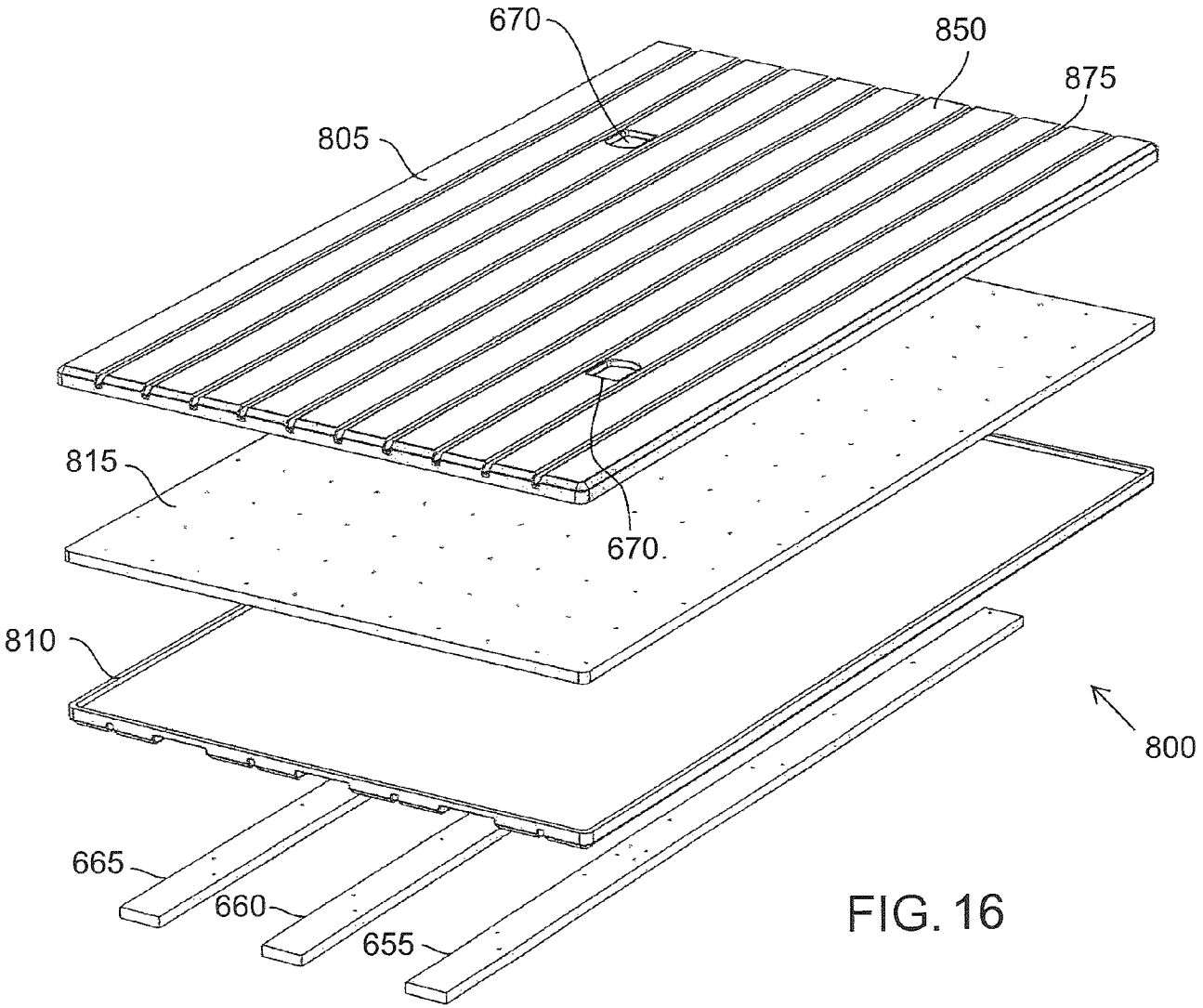
FIG. 16 is an exploded view of a mat that utilizes a flat core construction, with the encapsulation artificially separated into upper and lower portions to illustrate its position about the core construction.

FIG. 16 illustrates these additional embodiments of the invention. As in FIGS. 9 and 12, the encapsulation for the mat 800 is shown in two artificial sections, namely an upper portion 805 and lower portion 810 which are used to surround and encapsulate core construction 815. For this embodiment the core construction 815 is shown as a plate or sheet. The material for this plate or sheet can be any one of those mentioned herein including engineered wood, steel or other metals, or a reinforced thermosetting resin (e.g., reinforced with glass or other known material to provide increased strength). The sheet or plate has sufficient properties to provide strength and rigidity to the mat. The sheet or plate may include positioning pins or cones so that it would be properly placed in the mold after the mold is provided with the rubber crumb particles. As in the embodiments for FIGS. 9-14, space is provided for the boards 655, 660, 665 on the lower portion 810 of the encapsulation that provide interlocking and openings 670 are provided for attachment of lifting elements.

The upper and lower surfaces of the mold would be provided with protrusions that impart drain channels 875 into the top and bottom surfaces of the encapsulation. Unlike the mats of the other embodiments, the upper and lower surfaces are actually made of elongated strips of cured polyurethane matrix/rubber crumb rather than a coating over the boards or elongated members for the core construction. These strips, which are in reality formed when the resin is introduced into the rubber crumb particles, can be as thick as 2 to 4 inches on each of the top and bottom services and of the same length as the elongated members of an upper or lower ply of a three ply wood mat. These strips of course require much more rubber crumb than in the other embodiments where the encapsulation is in effect a coating over a three layer mat.

Instead of linear drain channels 675 as shown, the mat surfaces can be prepared with different configurations that provide recessed areas for drainage of water for better traction of vehicles or personnel that move upon the mats. These drain channels can be linear in parallel arrangement as shown or additional drain channels can be provided at 90 degree or other angles to the parallel channels. As the core construction is flat, the raised crumb rubber portions can be provided as segmented shapes of other than rectangles, such as triangles or other polygons. The shapes can take the form of raised or recessed letters, numbers, writing or other combinations of alphanumeric characters. Alternatively, the surface can be provided with grit, particles or other granular material that would provide a more slip resistant surface. All of these provide better traction when personnel or equipment are moving upon the mat.

Figure 17:
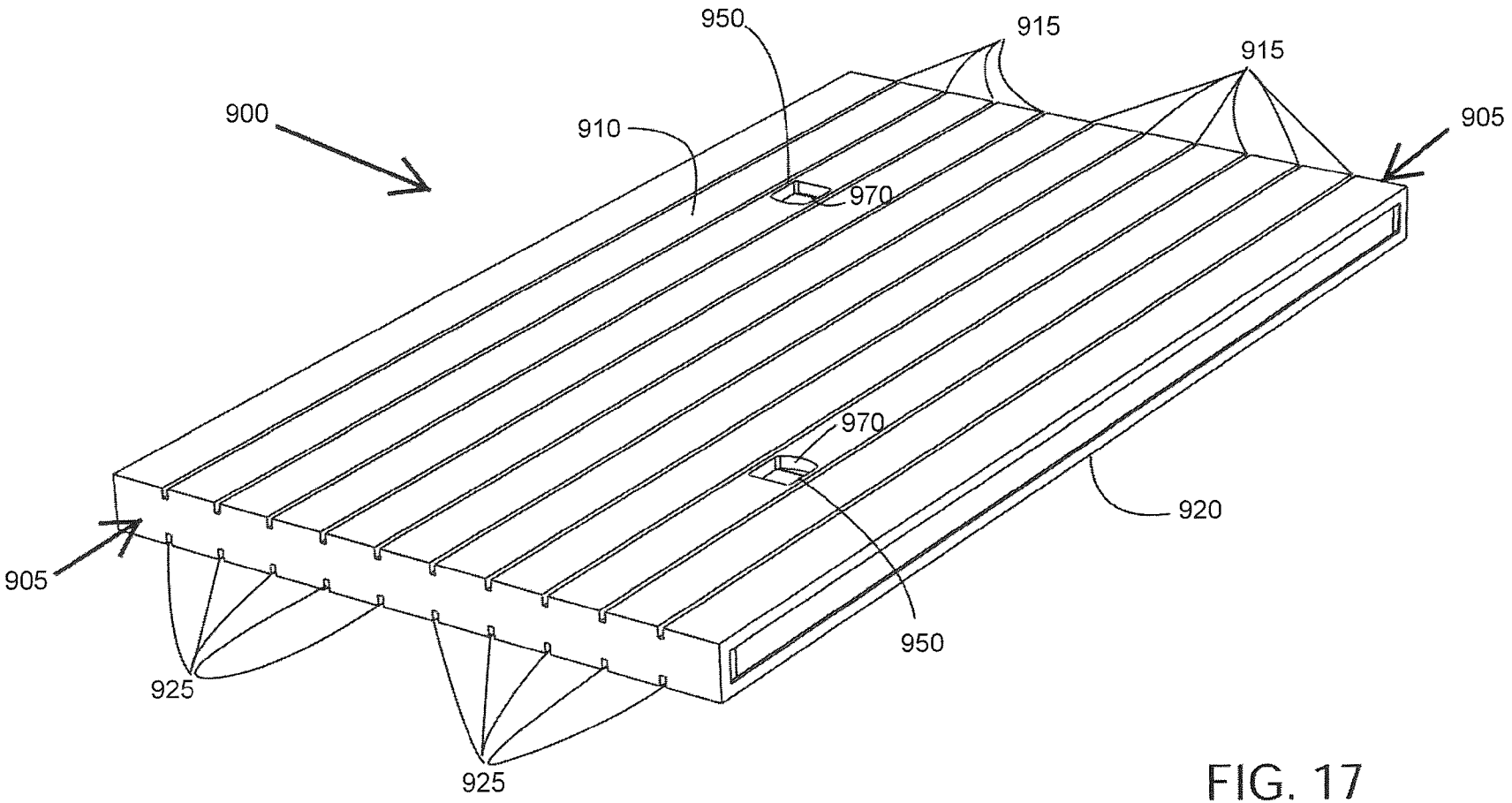
FIG. 17 illustrates another embodiment of an industrial mat according to the invention.
Figure 18:
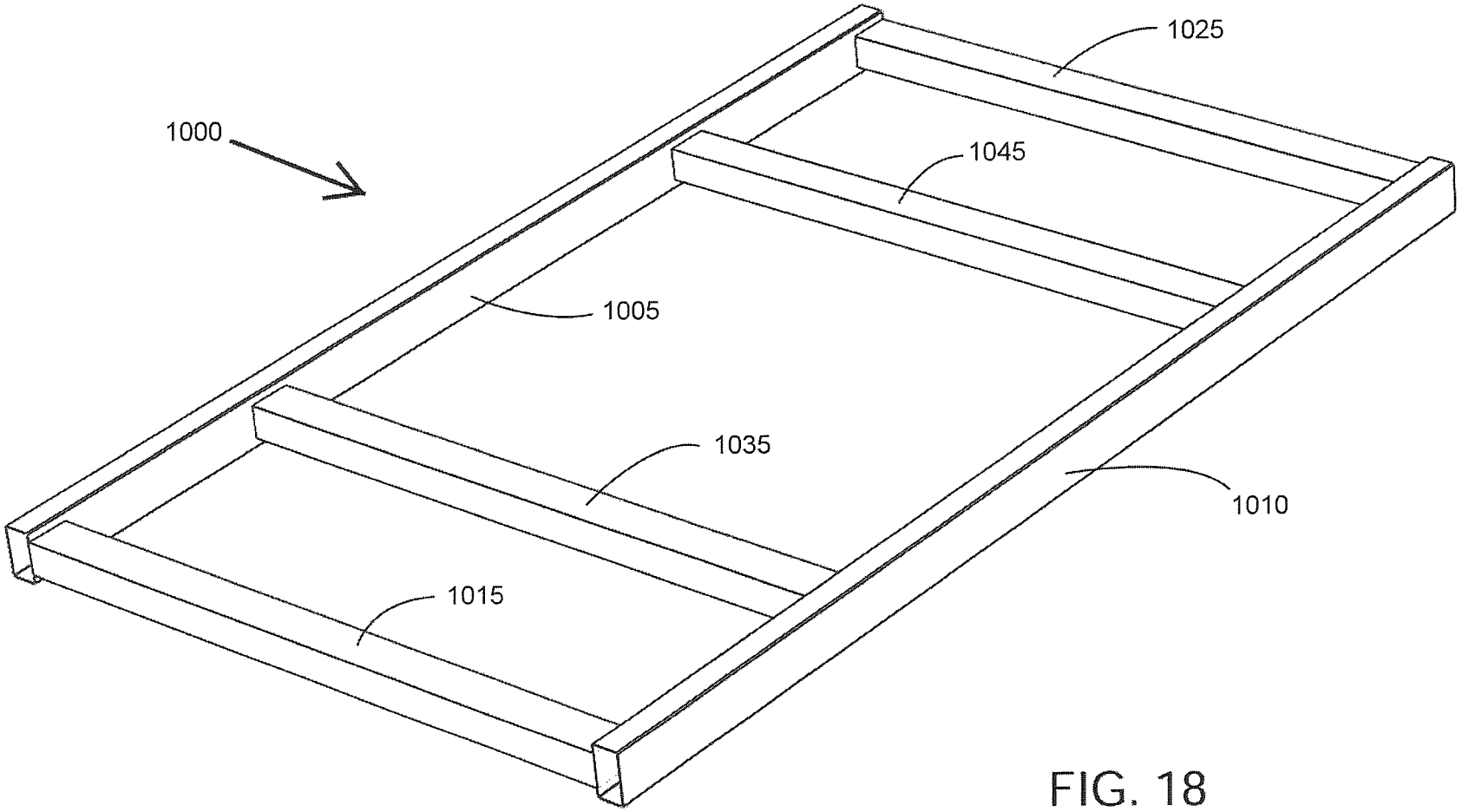
FIG. 18 illustrates a core structure for the mat of FIG. 17.

FIGS. 17-23 illustrate an additional encapsulating material that is used to encompass the entire mat including any spaces therein to form the encapsulated mat. FIGS. 17 and 18 illustrate a preferred embodiment of the invention wherein an industrial mat 900 is shown that includes therein a frame 1000 that is provided as a core structure and which is enclosed within an encapsulating structure 905 of a plastic material. As noted herein, the frame 900 provides the strength and backbone of the mat while the encapsulating structure 905 provides environmental resistance and protection of the frame and core.

The encapsulating structure 905 can be made of a variety of materials as noted herein. A wide range of thermoplastic, polymeric, thermosetting or elastomeric materials as disclosed herein can be molded or cast to the desired size and thickness of the mat. The encapsulating structure is typically molded as a unitary structure around a strength or support core. These materials can also be provided with conventional fillers to increase weight and hardness. They also can be reinforced with particulates, fibers such as glass, fabric or metal screening or scrim to reduce elongation and provide greater rigidity.

The top 910 and bottom 920 surfaces of the mat are also provided with drainage channels 915, 925 which are generally rectangular in shape and which typically have a width of 1.25 inch and a depth of 1 inch. It is of course also suitable to use U-shaped channels.

FIG. 17 also illustrates lifting elements 950 on the upper surface of the mat. These lifting elements 950 are configured as D shaped rings which are attached through the encapsulation to cross-members in recesses 970 so that the lifting element 950 can remain flat when the mat 900 is in use. Two lifting elements are shown but a skilled artisan can determine how many elements are needed for lifting of any particularly sized mat. If desired, lifting elements can also be provided on the boards attached to the lower surface of the encapsulation for versatility in the handling and transportation of the mat.

The core structure is preferably configured as a frame 1000 as shown in FIG. 18. This frame 1000 includes side members 1005 and 1010 which can be made of any one of a number of different materials. In one embodiment, side members are rectangular tubes made of metal such as steel or of an FRP pultrusion. The open areas of the tubes can be filled with additional material such as a polyurethane foam, sand, rubber crumb or other particulate material to provide additional support to the tube or weight to the mat. These side members 1005, 1010 are configured and dimensioned to provide sufficient strength to the sides of the mat and to resist forces imparted thereto when moving the mat or when heavy equipment is driven over the sides of the mat. Alternatively, these side members may be made of a solid material instead of a tube, with wood or engineered wood being preferred for this alternative. And as noted herein, the top, bottom and outer side portions of the side members are provided by a predetermined thickness of at least 0.25 or 0.5 inch to as much as 5 inches of the material of the encapsulating structure.

In certain embodiments, however, the thickness of the encapsulating material on the side and cross members can be as little as 0.125 inch to as much as 0.6 inch, especially when polyuria or polyurethane is used as the encapsulating material. Greater thicknesses, while not undesirable, are simply not necessary and add additional cost without additional benefits for that material.

The frame 1000 also includes a plurality of cross members which provide structural support for the side members. These cross members may also be made of rectangular tubes of metal such as steel or of an FRP pultrusion or of wood or engineered wood. Specifically, the forward end of the mat includes cross member 1015 while the rear portion of the mat includes cross member 1025 forming a generally rectangular frame. Additional cross members 1035, 1045 may be provided within the rectangular frame depending upon the size of the mat to provide additional reinforcement to the side members to form a more robust core structure that provides overall strength to the mat. The number of cross members depends upon the size and thickness of the final mat.

The cross members preferably are made of a material that is the same as that of the side members 1005, 1010 to facilitate formation of the frame by joining similar materials together, but it is also possible for the cross members to be of a different material. When different materials are used, the cross and/or side members are configured in a way that would allow their connection by bolting to form the frame. For example, the cross members can be provided with separate L-shaped flange members at each end so that one part of the flange is bolted to the cross-member and the other end is bolted to the side member. Of course, many other arrangements can be made by skilled artisans using good structural engineering practices and all are considered to be included in the scope of the present invention.

The frame can be made of steel, wood, engineered wood or fiberglass reinforced plastic in the form of beams or tubular structures. When the frame is made of tubular structures, those structures may be filled with a reinforcing material that provides strength or reinforcement. Also, the frame can includes elongated members therein to fill in a portion of the space between the side and cross members of the frame. These elongated members can be made of wood, engineered wood, end grain wood or open or filled thermosetting pultrusions, or a particulate filler of recycled rubber tire material, sand, gravel, earth or combinations thereof.

As shown in FIG. 18, the side members of the mat have a greater height than the cross members. Thus, the cross members are connected so that they are positioned in the center of the side members, with space provided both above and below the cross member so that the side members are taller than the cross members on both the top and bottom of the mat. This arrangement provides space for the channels 915, 925 in the upper 910 and lower 920 surfaces of the mat shown in FIG. 17 so that they do not contact the cross members and expose them to the elements during use of the mat. In fact, the encapsulating structure 905 provides a thickness of at least 0.25 inch and preferably 1 inch around and about all surfaces of the frame members.

When the frame members are made of steel, they can be simply welded together to provide the frame structure. Of course, if the frame members are made of FRP, they would be molded together or adhered together to form the frame structure of the mat. The plastic of the FRP pultrusions would be any one of the thermosetting plastics of the types mentioned herein but thermosetting polyesters and epoxies are preferred. When the frame members are made of wood, they can simply be bolted or riveted together. As noted herein, when different materials are used for the side and cross members it is also possible although not preferred to provide these members with an appropriate structure so that they can be bolted together.

The encapsulating structure is provided in any way that fills in all open spaces of the frame structure as well as to provide the desired thickness on the top, bottom and outer side of the side members and the outer sides of the front and back cross members that form the frame. This can be done by placing the frame structure in a mold and providing the encapsulating material within and upon the frame as it sits in the mold.

Alternatively, the encapsulation can be provided in other ways, including but not limited to immersion coating of the entire core construction or by painting or otherwise depositing encapsulation material to completely encapsulate the core construction. The encapsulating material is typically a thermoplastic polymer, a thermosetting resin or an elastomeric material. For example, the entire core construction can be filled and coated with any of these materials to form a solid unitary mat structure.

Figure 19:
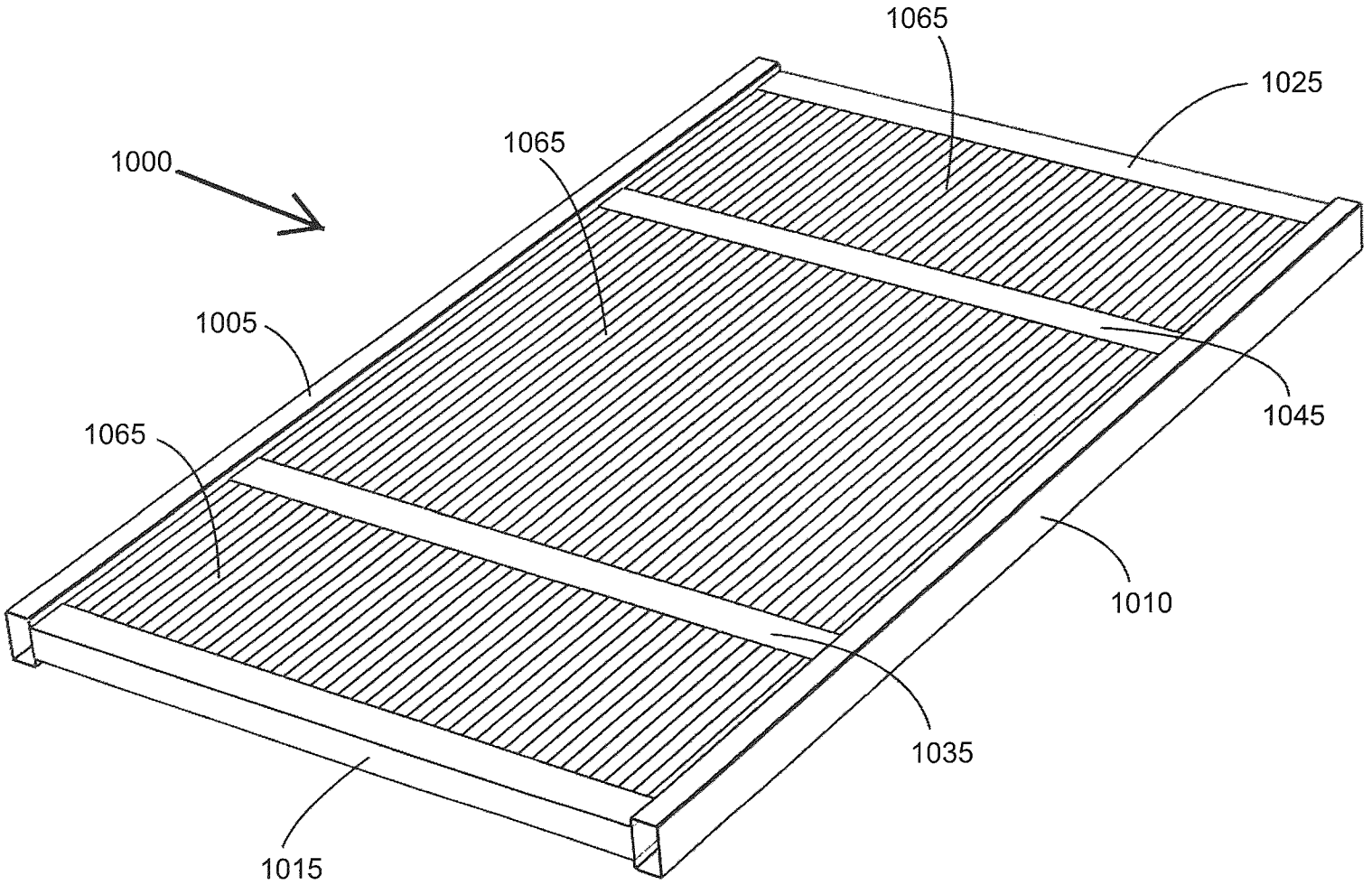
FIG. 19 illustrates the use of elongated members to fill in the open space of the core structure of FIG. 18.

FIG. 19 illustrates a variation of the invention that utilizes less plastic or elastomeric material to form the encapsulating structure. In this embodiment, the open areas of frame 1000 of FIG. 18 are filled with elongated members 1065 as shown in FIG. 19. These elongated members can be made of any of the materials disclosed herein, including wood, engineering wood, or FRP structures. Metal members can be used but these generally are more expensive than the other members mentioned in this paragraph and provide more strength that is necessary for the frame. Typically, wood members are used with treated pine being preferred from a cost standpoint. End grain wood sections can be provided for greater strength. Although these members are shown arranged to be perpendicular to the side members and wedged between them so that they are maintained in place during the application of the encapsulating material, these members can instead be oriented parallel or both parallel and perpendicular to the side members if desired. Also instead of wedging the boards in place, the can be bolted or adhered together before being bolted or adhered to the side members. Thus, when the encapsulating material is added it does not need to sill in the otherwise open spaced between the side and cross members.

Alternatively, it is also possible to use a plate, sheet or mesh upon the upper and lower surfaces of the cross members so that foam, particulate matter, small particles of plastic or rubber including rubber crumb can be added to the areas between the plate, sheet or mesh to fill in those areas. When a mesh is used, this generally allows the encapsulating material to penetrate into those areas and fill in any interstices between the particles and form a completely solid mat which is a preferred arrangement of the present invention. Also, the use of metal plate or sheet, for example, with the appropriate number of cross members enables the center areas of the core structure to remain open without reducing the compression strength of the mat. Typically, the sheeting may be plywood, plastic, metal or composite material, and can be attached to the mat by bolting or by an adhesive. The sheeting and core can be maintained in position be being encapsulated. For a more secure attachment, holes for the bolts can be drilled through the plate or sheeting to facilitate assembly by allowing passage of the bolts therethrough.

All of the mats according to the invention are to be installed on properly prepared ground so that they will perform acceptably. Ground preparation must be on a uniform material of uniform flatness (i.e., within +/−12" over an 8'×14' surface). Crushed stone or rock no larger than 4" diameter is acceptable for preparing the ground as a substrate for supporting the mats.

All mats according to the invention are designed to meet the following product specifications for preferred implementations as temporary roadways, equipment support surfaces, platforms and similar applications. The mats of the invention do not cause contamination of the ground surfaces upon which they are applied.

Figure 20:
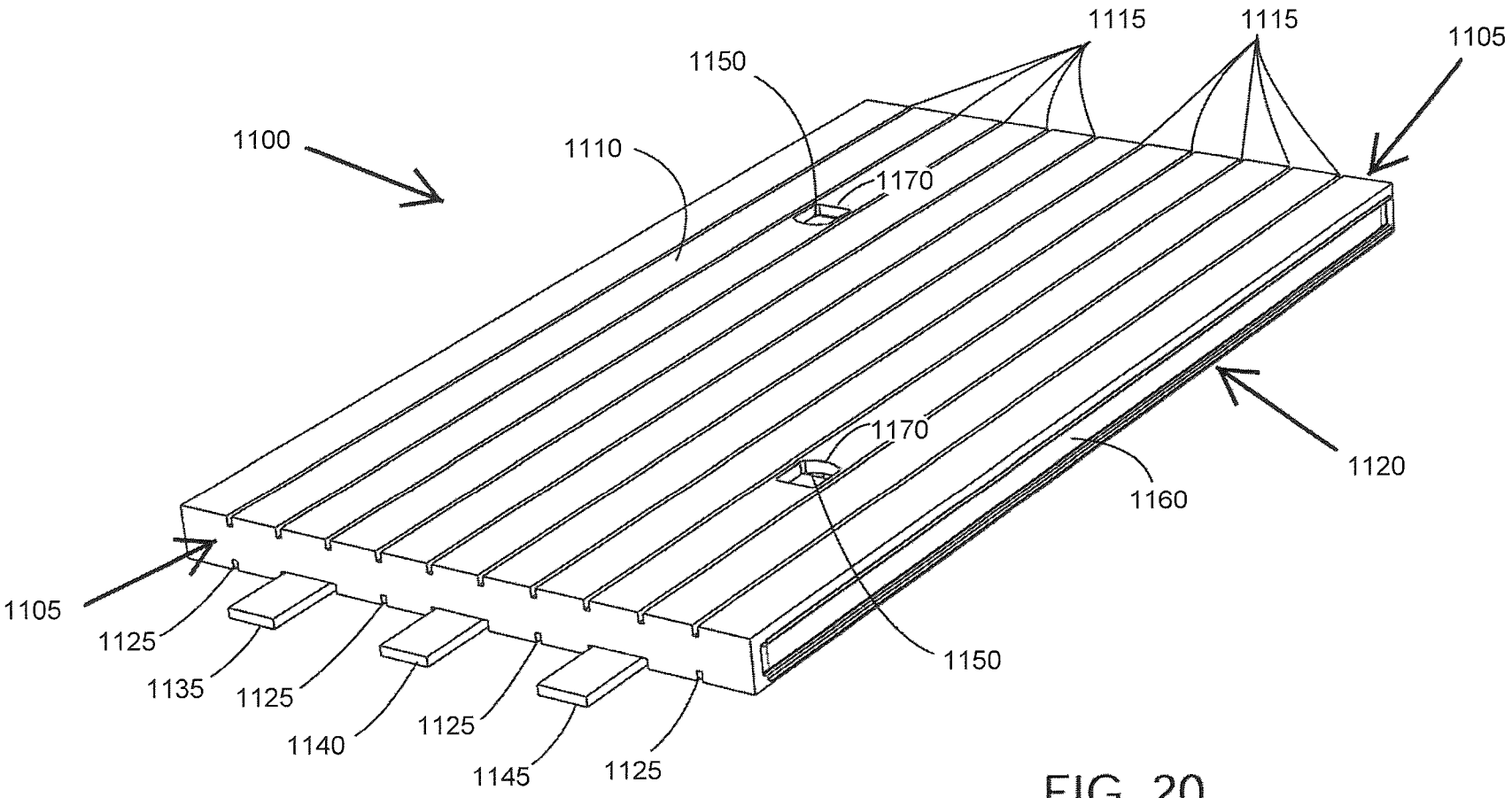
FIG. 20 illustrates another embodiment of an industrial mat according to the invention.

Preferred overall mat dimensions are approximately 8' wide×6" tall and are either 12 ft, 14 ft or 16 ft in length. The interlocking feature will extend the length of the mats by about 1 ft at three locations at one end of mat. U.S. Pat. No. 4,462,712 discloses mats which contain interlocking fingers and recesses which are preferred for use in the present invention. These are also shown in FIGS. 20-21 herein, wherein another preferred mat 1100 is illustrated.

Mat 1100 is configured in the same way as mat 900 and core structure 1000 in FIGS. 17 and 18 except that mat 1100 includes additional features that provide performance benefits. One feature is the use of the interlocking boards on the bottom surface of the mat. These interlocking boards 1135, 1140, 1145 are typically made of wood and are bolted to the mat because they provide good wear resistance but if damaged or broken, they can be easily removed and replaced so that the mat can continue to be used in service without having to provide a new encapsulated core structure.

Figure 21:
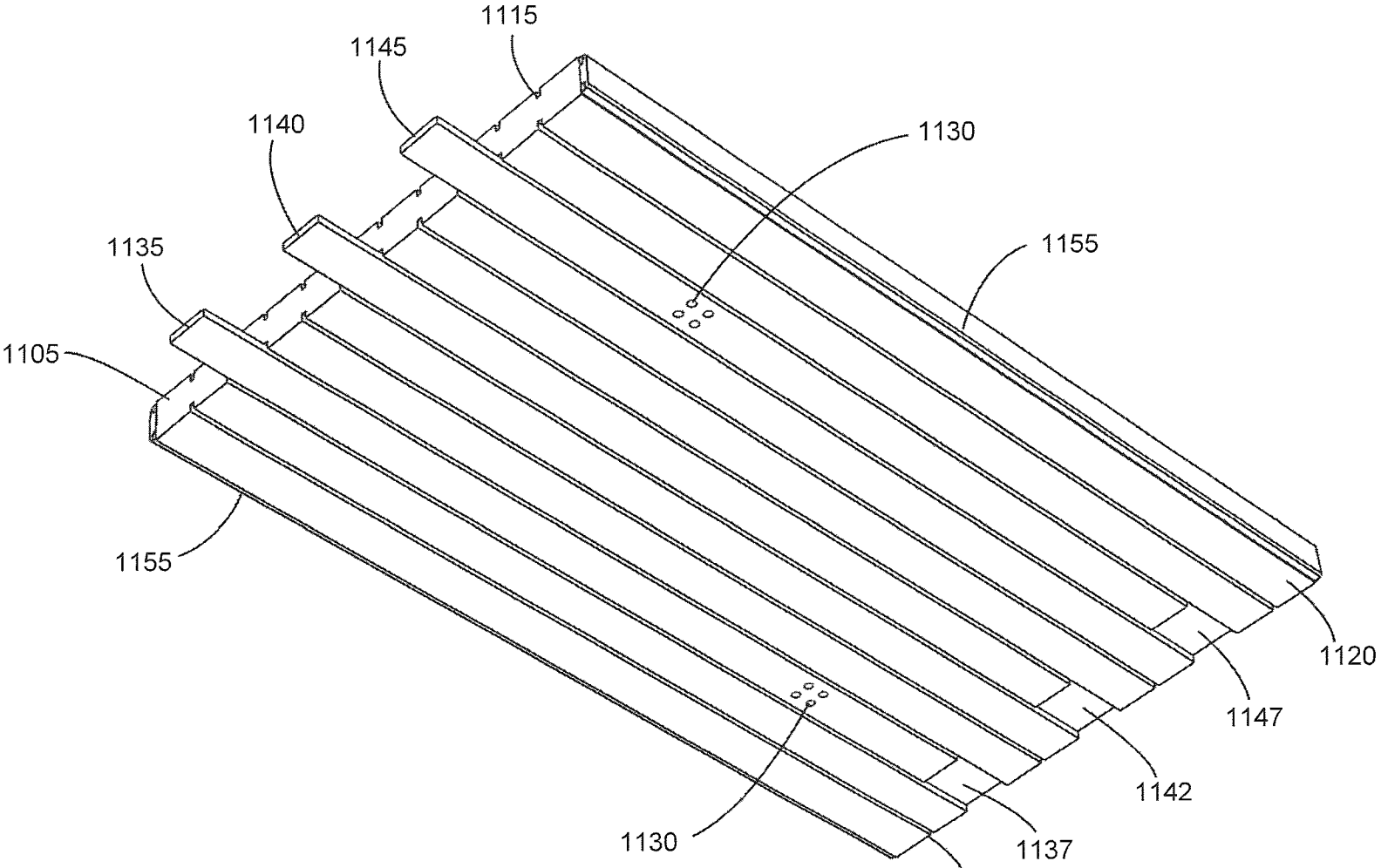
FIG. 21 is a bottom view of the mat of FIG. 20.

To provide the interlocking structure, as best shown in FIG. 21, recesses are provided on the bottom surface of the mat. These recesses 1137, 1142, 1147 are slightly wider than the width of the interlocking members 1135, 1140, 1145 that are to be bolted to the mat using bolts 1130. As shown, the interlocking members are typically boards of wood or other materials that are disclosed herein that have the same length as the mat but are offset to provide a stick out portion on one end and an open recess on the opposite end. Thus, the stick out portion of one mat can be received in the open recesses of an adjacent mat so that the two mats can be interlocked together.

The number and size of the interlocking boards is not critical to the invention and typically, at least two or three boards (as shown) are provided. The width of the boards can be between 4 and 8 inches or in some cases larger or smaller as desired depending upon the overall size of the mat. For an 8 foot wide mat, the use of three or four 4 inch wide boards or alternatively three or four 8 inch wide boards would be suitable. In some situations, a lesser number of wider boards or greater number of less wide boards can be used. And as noted, the boards can be made of different materials such as wood, engineered wood, or an FRP pultrusion as long as it is possible to bolt or otherwise securely attach those boards to the mat. Bolting of course is preferred since it will allow replacement of the boards if they become damaged or deteriorated during use. The bolts can be provided as an extension from a cross member. In particular, when the cross members are made of metal, the bolts can be welded to the cross member and the boards can be attached to the mat by nuts which are secured to the bolts after the bolts pass through the boards.

The recesses that are provided on the bottom surface of the mat are as deep as necessary to accommodate the thickness of the boards. Typically a one or two inch thickness is sufficient with the recesses sized correspondingly. The recesses are not so deep as to contact the cross members and as noted the thickness of the encapsulation would be at least 0.25 or 1 inch on the cross member as well as beneath the boards. Appropriate configuration of the cross members is needed to achieve the overall tolerances and sizes of the mat and encapsulating structure thickness.

Figure 22:
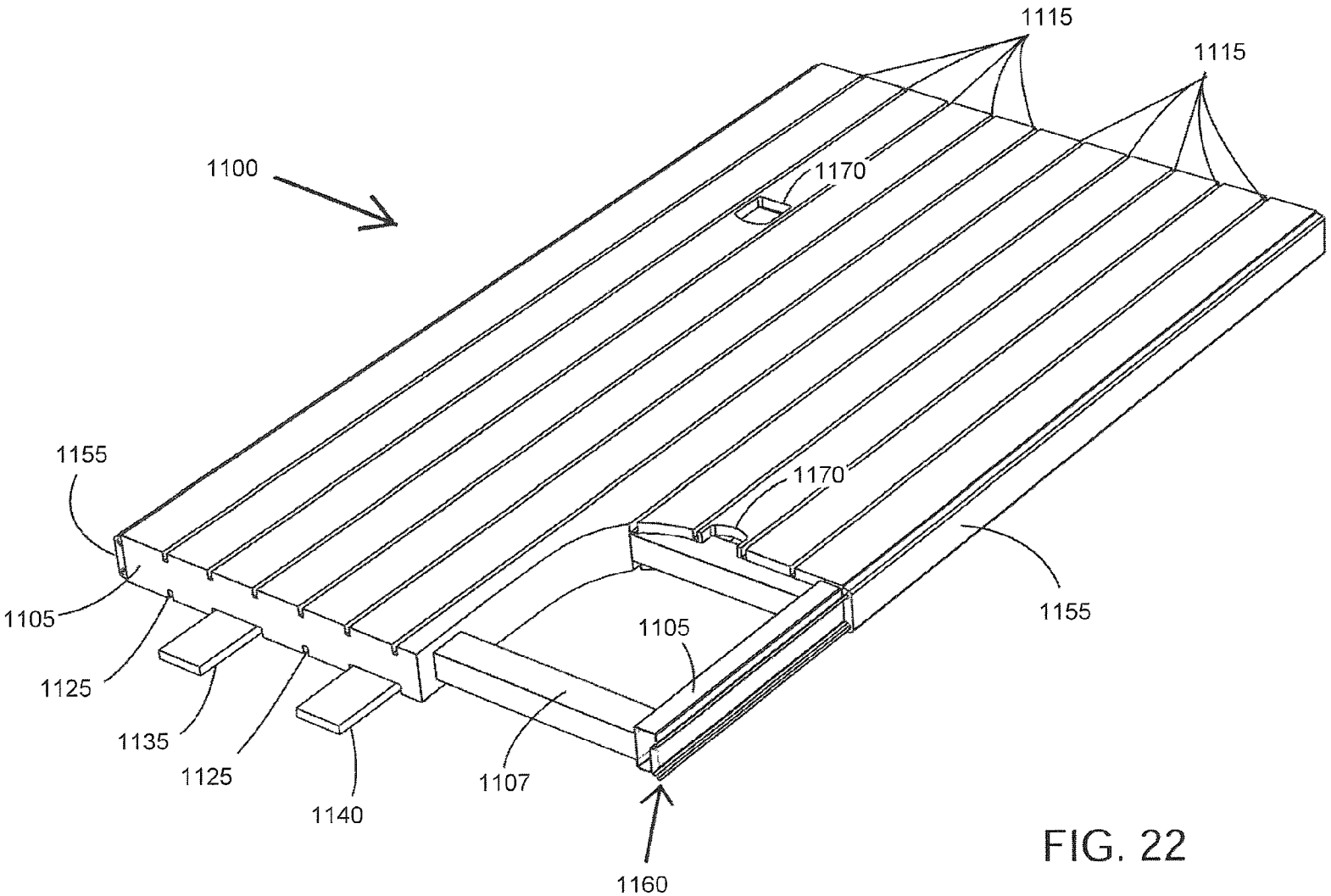
FIG. 22 is a view of the mat of FIG. 20 with a cut-out portion to show the construction of the core structure and its location within the encapsulating structure.
Figure 23:
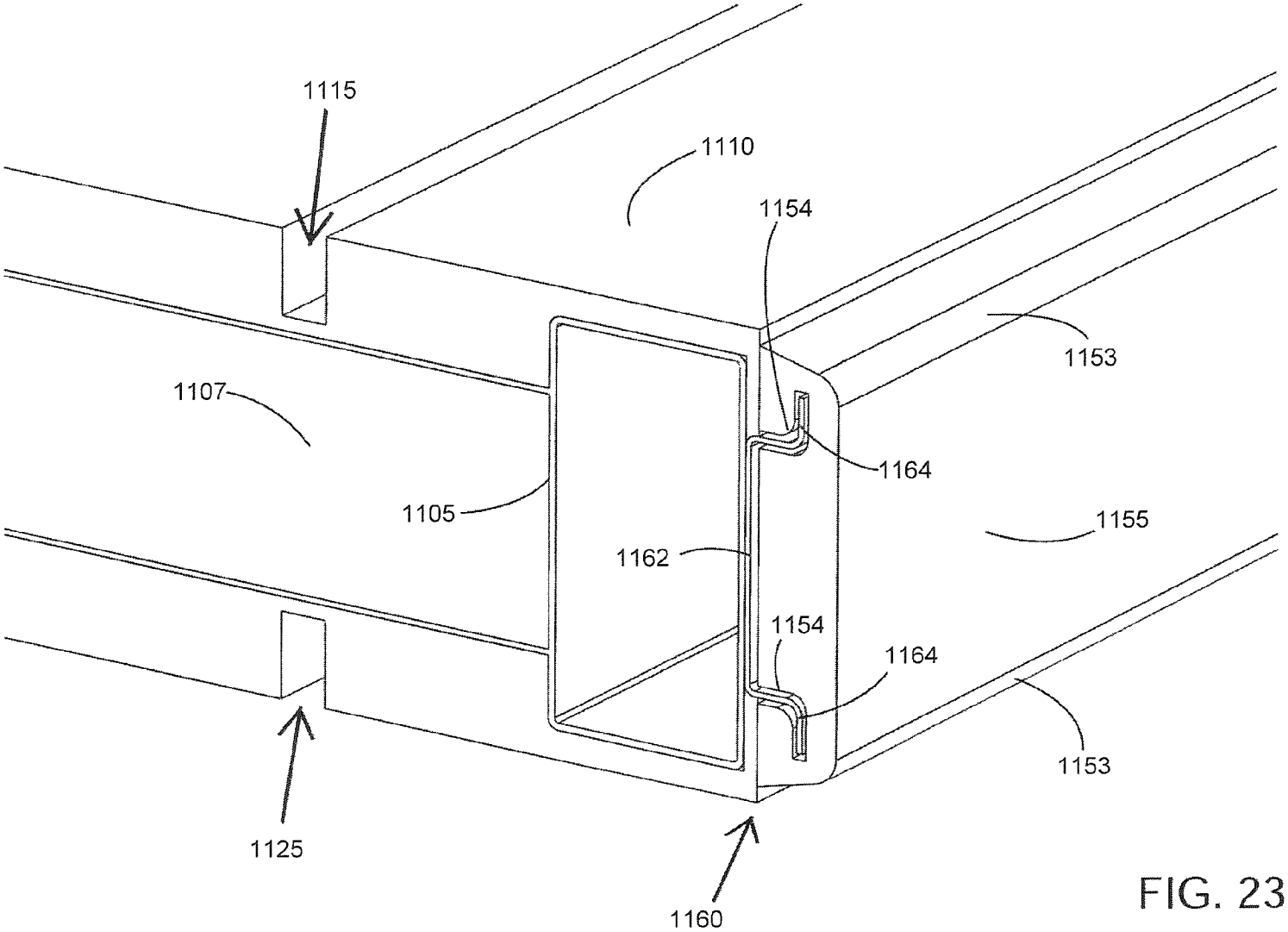
FIG. 23 is an enlarged view of the core of structure to show the details of the bumper support that is attached to the core structure.

FIGS. 20-23 also illustrate an additional feature of the invention in the form of a connector element 1160 that is used to mount a bumper member 1155 onto the mat to provide additional abuse protection to the sides of the mat. As best shown in FIGS. 22 and 23, the connector element 1160 has a base portion 1162 that is attached to the side member. When the side member is steel, the base portion 1162 can be made of metal and welded to the metal side member. If the side member is made of a different material, the base portion 1162 can be attached by bolting, nailing or riveting. Attaching the base portion by welding is preferred as is the provision of all frame members to be made of a metal with steel being the optimum material.

Base portion 1162 includes L-shaped arm members 1164 at each end. These arm members are received in a correspondingly shaped slots 1154 in bumper member 1155. The bumper member 1155 is typically made of a resilient and durable plastic material, such as high density polyethylene so that it can withstand shock or impact as the mats are being moved into position or transported to a job site and installed at the appropriate location. The L-shaped slots 1154 of bumper member 1155 extend along the entire length of the bumper member. Thus, for installation, the bumper member is slid onto the side member of the mat with slot members 1154 for engaging arm members 1164 of connector member 1160. End clips, screws or bolting can be used to maintain the bumper member in position and prevent its unintended removal from the mat by sliding off the arm members 1164 while also allowing slight movement for expansion and contraction of the mat.

Alternatively, the bumper members can be directly attached to the side members by bolting. Whatever type of attachment means are used it must be recognized that the bumper members will experience the greatest impact and abuse during movement of the mat and for this reason they may become damaged and require replacement. Thus, any mechanical connection of the bumpers to the mat must be one in which the bumpers can be relatively easily removed and replaced when necessary.

FIG. 22 also shows the cross-section of the mat by the cut out portion on the lower right corner. The open space is shown as being filled by the encapsulating material 1105 but that the space is relatively large and requires quite a bit of material to be filled into those open spaces of the mat. This is why the construction of FIG. 19 is preferred since the inclusion of additional members or filler into those spaces greatly reduces the amount of plastic or elastomeric material that would be needed to form the encapsulating structure.

FIG. 22 also shows that the connector element 1160 can be welded to the side member prior to encapsulation of the frame. In doing this however the encapsulating material is molded so that it does not extend over the arm members 1164 of connector element 1160 as those need to be exposed to receive bumper element 1155.

FIG. 23 also shows the drainage channels 1125 that allow water to drain from the mat during use.

In certain specific applications, the upper surface and possibly the lower surface of the encapsulation structure can require additional layers for further extending the service life of the mat. To attach these additional layers, the cross and side members can be provided with appropriate bolting that extends through the encapsulating structure and allows attachments of the additional layers.

These optional additional layers generally include two (2) layers of individual wood or composite boards, having cross section dimensions of 1.75" by 8". These can both be on the top side of the mat or one layer can be on the top side and one on the bottom side so that the additional layers form the outer layers of the mat. The members of the additional layers would generally be joined together by bolting, nailing or riveting if made of wood or by other attachment means such as adhesives if made of FRP. They are also attached to the mat in a way that facilitates their replacement if damaged during use, with bolting again being the preferred method of attachment.

In another alternative embodiment, each board of the various layers of the mat are encapsulated with the material or a coating of one or more of the various materials mentioned herein. The encapsulation can be provided in other ways, including but not limited to immersion coating of each board or by painting or otherwise depositing encapsulation material to completely encapsulate the boards. Combinations of these techniques can be used as well, wherein a sheet or layer of the material is initially applied to the boards. Thereafter, the ends of the boards can be sealed with coating material and the overlapping edges of the sheet or layer sealed with an adhesive. Polymer sleeves can also be used with the ends of the sleeved folded upon the ends of the boards. Thus, each board will be protected from moisture as well as from abrasion due to traffic or equipment that passes over or is placed upon the mat. The outermost layers experience the greatest traffic and for that reason may be further provided with an additional surface coating of a material that provides additional abrasion resistance or with particles of various materials such as inorganic, rubber or plastic material to provide a non-slip surface. Crumb rubber can be used for this purpose. For environmental benefits, the crumb rubber can be obtained by grinding used automobile tires into the desired particulate size.

The provision of a encapsulation on the boards of the central layer protects that layer from moisture which would cause rotting or deterioration of the boards. This also enables the central layer to be reused if the boards of the outer layers require replacement.

When assembling the encapsulated boards into the mat, care should be used to close off any holes made for bolts or other attachment means. Bolts can be made of stainless steel or aluminum to prevent rusting while the holes through which they pass can be sealed off with a rubber gasket or o-ring placed beneath the bolt heads or nuts to make it more difficult for moisture to enter into the wood through the bolt holes.

And while offsetting of certain boards is shown for providing an interlocking with adjacent mats, this is not always needed such that interlocking can be considered to be an optional yet desirable feature. Interlocking is often preferred to avoid staking of the mats to the ground or to avoid including other more complex components for use in connecting adjacent mats together.

Another feature of the invention is the use of color coding to identify the core construction of the mat. As the encapsulation is opaque, it is not possible to visually determine how the core is made. Thus, a color coding system can be used to identify the specific core construction. This can also be used to identify mats for a particular customer or end user. When mats are rented or leased, the color coding can be used to identify which mats belong to the leasing company compared to mats provided by others. The color coding can be of a single color or of certain stripes, patterns, dots or other indicia that provides a "signature" that identifies the specific core that is present in the mat or a particular end user or owner of the mat.

All of the mats according to the invention are to be installed on a prepared ground surface so that they will perform acceptably. Ground preparation is typically upon a material of uniform flatness (e.g., within +/−12" over an 8'×14' surface). Crushed stone or rock generally no larger than 4" diameter is acceptable for preparing the ground as a substrate for supporting the mats.

All mats according to the invention that include the most preferred core construction or alternatives thereof are designed to meet the following product specifications for preferred implementations as temporary roadways, equipment support surfaces, platforms and similar applications. A further benefit of the mats of the invention is that they do not cause contamination of the ground surfaces upon which they are applied.

Preferred overall mat dimensions are approximately 8' wide×6" tall and are either 12 ft., 14 ft. or 16 ft. in length.

The interlocking feature will extend the length of the mats by about 1 ft at three locations at one end of mat. U.S. Pat. No. 4,462,712 discloses mats which contain interlocking fingers and recesses which are preferred for use in the present invention.

The mats typically include three (3) layers of individual wood or composite boards, having cross section dimensions of 1.75" by 8".

The spacing between individual boards or components in the upper layer is preferably approximately 1.25" to allow water to drain from the mat. The slip resistance of the mat is improved by the draining of the excess water, especially when use in locations that experience heavy rain or snow conditions.

The preferred mats have physical properties that meet or exceed the physical properties of a conventional white oak mat.

The mat must also provide sufficient load bearing capacity: a fully supported mat (one that is properly installed on an approved ground surface preparation) must withstand a 10 ton load, spread over a 12" diameter surface without degradation of mat properties or permanent deformation of core construction of the mat. The core would have a crush resistance of between about 600 and 800 psi depending upon the application. This provides resistance against compression while not detracting from providing resistance to torsion forces that applied to the mat by vehicles passing thereover.

Optionally and preferably, the perimeter edges of the mat are provided with additional protection to prevent or reduce damage to the core construction of the mat from side entrance or egress onto the mat from large vehicles with steel tracks. The edge material helps protect the core construction and may be removable. The edge material may be made of wood, metal, or a plastic or elastomeric material.

Preferably, the encapsulation is relatively non-flammable. Flammability of mat is defined as Class 2 (B) flame spread when measured by ASTM E84 test criteria. The flammability properties of the encapsulation materials can be enhanced by adding the appropriate conventional flame retardant or other additives that are known to impart such properties.

The encapsulation should also allow dissipation of static electricity. For this purpose, the encapsulation can include carbon black, metal particles or other conductive fillers.

To prevent premature deterioration of the encapsulation, the material for the encapsulation should contain UV inhibitors as necessary and in an amount sufficient to reduce deterioration of physical properties or color.

To assist in gripping of vehicle or personnel traffic on the mat, a non-slip or textured surface can be applied to the exposed surface of the encapsulation. This can be sand or other grit material that is embedded in the encapsulation during preparation or molding or that is later added with an adhesive or a coating.

Alternatively, the provision of a plurality of channels or grooves in the encapsulation on both the top and bottom surfaces of the mat can be used to provide traction to objects moving on the top surface of the mat and to provide resistance to slipping when the bottom surface of the mat is placed on wet or muddy ground surfaces.

For ease in moving of the mats, attachment points can be provided that allow for lifting and handling of individual mats. Lifting hardware preferably includes D rings, O-rings, chain, or cables at 2-4 locations on the upper surface of the mat. The exact position and attachment of lifting hardware is designed based on the size and weight of the mat and is intended to avoid damage to the encapsulation or the internal structure of the mat.

The core construction of the mat preferably is not hollow. If hollow components are used for the various layers of the core construction, such as metal lath, metal sheets with openings provided therein, thermoplastic or fiberglass reinforced thermosetting plastic structures with open or closed cells, or the like, the openings or cells may preferably be filled with a non-absorbent material. A wide variety of different plastic, elastomeric or foam materials can be used for this purpose. The hollow portions can be used as is or can be provided with filler or other materials to increase or decrease weight as needed. Fillers of glass, ceramic or metal particles can be included to provide additional weight or strength to the mat. Other materials such as recycled rubber tire material or other environmentally friendly materials can instead be used. Preferably, the mat has a weight that is on the order of a white oak mat of similar size.

For a more advanced product, the core construction layer may be made of environmentally resistant material to further prevent against degradation due to weather conditions in the event that the encapsulation becomes damaged or otherwise compromised to allow liquid to enter into the core construction.

The term "environmentally resistant material" means a material that is not subject to deterioration by water, moisture or other environmental conditions when compared to a conventional wood material such as white oak that is commonly used for such mats. This term includes thermoplastic and thermosetting materials as disclosed herein along with elastomers and even metals such as steel, aluminum or stainless steel. While steel does rust when encountering moisture or water, this is not considered to be a deterioration of the material as it is a surface phenomenon that does not affect the physical properties of the material but instead just detracts from its surface appearance. To avoid this, the steel components can be coated or painted to provide a better appearance and even further environmental resistance. Under certain conditions treated wood can withstand rotting and degradation much better than untreated wood such that it would be considered to be an environmentally resistant material because of it improved resistance against rotting.

A number of additional features may be provided in the mats of the present invention. A radio frequency identification (RFID) tag can be embedded into the access mats in a routered pocket in the core construction to enable the access mats to be monitored in an inventory system or when rented for use. The tag provides a unique identification serial number for each mat, such that the mats which are being used or rented can be tracked and accounted for as to location of use. The mats can be scanned when in a warehouse, when loaded on trucks for delivery, when delivered to a job site, or when collected from a jobsite after use. The RFID tags can be active or passive and if desired, other tracking devices such as barcodes could similarly be for the same purposes. It is preferred, however, that the RFID tag be embedded in the mat so that it is protected from damage by the encapsulation. When a barcode or other surface mounted tag or indicia is used, it should be placed on a surface portion of the mat that is less likely to experience wear or abuse. Thus, the tag may preferably be applied onto the side of the mat so that it is not directed exposed to traffic on the mat.

In order to manipulate the mats for loading/unloading, or moving from one location to another or for installation and retrieval, the mats can include a retractable lifting element. This can be the lifting elements described above and those elements lie in a recess in the top surface of the mat during use for ease of access and to prevent tripping or damage to items moving over the mat or damage to the lifting elements themselves. Alternatively, a more complicated design such as that of US patent publication 2008/0292397 can be used.

To assist in the use of the mat during the night or on days that are dark due to poor weather conditions, the mat may include one or more lighting elements, such as those disclosed in International application WO 2006/048654. These lighting elements would preferably be embedded in the encapsulation. The encapsulation can be provided of clear plastic, so that the lighting element may be positioned below the encapsulation for better protection of the lighting element during use. As the embedding of the lighting element below the encapsulation surface can result in reduced luminosity, a skilled artisan can best determine the appropriate location for the placement of the lighting element in or under the encapsulation and for providing the encapsulation of the appropriate color or clarity to achieve the desired lighting brightness. This can also be adjusted by providing a larger number of lighting elements or of lighting elements of larger size.

The present invention provides unexpected benefits over the art in that the encapsulation provides resistance to abrasion and abuse of the core construction while also preventing moisture, water or chemicals from the surrounding environment from penetrating into the core construction. Additionally, the mats have anti-static properties and provide traction and anti-skid surfaces depending upon the finish of the encapsulation or coating surfaces that are exposed. These can be provided with particulate matter of any type of inorganic particles or plastic or rubber pellets to provide an anti-skid surface. The amount of particles would depend upon the size and can be determined by routine testing depending upon the material use for the encapsulation or coating. Also, certain materials such as rubber, when present as or in the encapsulation, act as a heat sink to allow ice to melt more quickly from the mat which is a safety feature when the mats experience snow and ice conditions in winter. The mats can also be pigmented to be place to assist in absorbing sunlight to melt ice or snow.

All of these features contribute to the ability of the mat to provide a much longer service life compared to when wood components are used alone since the encapsulation prevents rotting or other chemical degradation of the wood components of the core construction. Further enhancements in service life can be expected by providing a core construction made of thermosetting or thermoplastic materials or plastic coated metal. Finally, when the service life of the encapsulation is being approached, the encapsulation can be cut off or otherwise removed from the core so that a new encapsulation can be applied. Alternatively, when single boards are encapsulated, only those where the coating or encapsulation is damaged need replacement. To the extent that any of the components of the upper or lower layers are damaged, they can be replaced so that a new mat can be made with the reuse of a substantial part of the core construction. In some situations, such as where the core construction remains in relatively good condition from, e.g., the use of non-wood core components, only a portion of the encapsulation can be removed and replaced, thus providing further savings in recycling rather than replacing the mat.

What is claimed is:

1. An encapsulated industrial mat comprising:

a core construction that provides strength and rigidity to the mat, the core construction comprising:

(a) plural layers or plies of wood or engineered wood components that are nailed, bolted or riveted together to form a rigid core construction, or (b) a layer or ply of a thermoplastic material in the form of a plurality of adjacently arranged elongated members or a sheet member that optionally includes open or closed cells therein or therethrough that is formed as an integral member or that is joined or welded together to form a rigid core construction, or (c) a thermosetting plastic support structure in the form of a plate, beam, grid, grating, ladder or pultruded tubes that are nailed, bolted or riveted together to form a rigid core construction, or (d) a metal support structure in the form of beams that are welded together to form a frame or ladder structure, or a plate that optionally contains apertures therein, or (e) at least two layers or plies of elongated, sheet, plate, beam, grid, grating, ladder or tube members wherein the layers or plies are fastened or joined together to form a rigid core construction; and an encapsulation of a thermoplastic, thermosetting or elastomeric material or a mixture thereof that surrounds and fully encapsulates the entire core construction and forms top, side and bottom surfaces of the mat, wherein the encapsulation has a relatively uniform thickness that is between about 0.25 and about 2 inches on all surfaces of the mat to provide environmental resistance to the wood components or core construction that it encapsulates, while also providing abrasion resistance to the mat;

wherein each layer, ply or support structure has a length and width that substantially corresponds to that of the mat and has a thickness of not less than 0.75 inches and not more than about 12 inches or between about 1 and about 8 inches or between about 1.5 and about 4 inches; and wherein the thermoplastic material is selected from the group consisting of acrylonitrile butadiene styrene, acrylic, celluloid, cellulose acetate, cycloolefin copolymer, ethylene-vinyl acetate, ethylene vinyl alcohol, a fluoroplastic, an ionomer, an acrylic/PVC alloy, a liquid crystal polymer, polyacetal, polyacrylate, polyacrylonitrile, polyamide, polyamide-imide, polyaryletherketone, polybutadiene, polybutylene, polybutylene terephthalate, polycaprolactone, polychlorotrifluoroethylene, polyethylene terephthalate, polycyclohexylene dimethylene terephthalate, polycarbonate, a polyhydroxyalkanoate, polyketone, polyethylene, polyetheretherketone, polyetherketoneketone, polyetherimide, polyethersulfone, polyethylenechlorinate, polyimide, polylactic acid, polymethylpentene, polyphenylene oxide, polyphenylene sulfide, polyphthalamide, polypropylene, polystyrene, polysulfone, polytrimethylene terephthalate, polyurethane, polyvinyl chloride, polyvinylidene chloride, and styrene-acrylonitrile.

2. The mat of claim 1, wherein the top, surface, the bottom surface, or both the top and bottom surfaces of the mat include a plurality of channels or grooves to provide traction to objects moving on the top surface of the mat and/or to provide resistance to slipping when the bottom surface of the mat is placed on wet or muddy ground surfaces.

3. The mat of claim 1, wherein the core construction is made of materials that provide a load bearing capacity that is able to withstand a load of at least 600 to 800 psi without permanently deforming the core construction and the encapsulation has a thickness of 0.25 to 1 inches.

4. The mat of claim 1, wherein the core construction comprises:

two or three layers or plies of elongated components or members at least some or all of which are wood or engineered wood, wherein each layer or ply comprises wood or engineered wood in the form of a plurality of adjacently arranged elongated members or a sheet member; or one of the layers or plies comprises a structure of a thermoplastic material in the form of a plurality of adjacently arranged elongated members or a sheet member, and another layer or ply comprises a plurality of adjacently arranged elongated members or a sheet member of engineered wood or a thermosetting plastic material; or one of the layers or plies comprises one or more elongated components or members of metal and another layer or ply comprises a plurality of adjacently arranged elongated members or a sheet member of wood or engineered wood; or one of the layers or plies comprises a reinforced thermosetting plastic support structure in the form of a plate, grid, grating, ladder or pultruded tubes and another layer or ply comprises a plurality of adjacently arranged elongated members or a sheet member of wood or engineered wood.

5. The mat of claim 1, wherein the core construction comprises a central layer made of a sheet, a plurality of elongated members, a plurality of compartments, or combinations thereof and at least one additional layer positioned adjacent the central layer wherein the additional layer is made of a sheet, a plurality of elongated members or combinations thereof.

6. The mat of claim 1, wherein the core construction comprises a central layer made of a sheet, a plurality of elongated members, a plurality of compartments, or combinations thereof and an upper layer positioned above the central layer wherein the upper layer is made of a sheet, a plurality of elongated members or combinations thereof, and a lower layer positioned below the central layer wherein the lower layer is made of a sheet, a plurality of elongated members, a plurality of compartments, or combinations thereof.

7. The mat of claim 1, wherein the core construction comprises 2 or 3 layers containing elongated members of wood or engineered wood each having a modulus of about 1.6 M psi±20%.

8. The mat of claim 1, wherein the encapsulation comprises a thermoplastic material.

9. The mat of claim 1, wherein the encapsulation comprises a thermosetting material.

10. The mat of claim 1, wherein the encapsulation comprises a polyurethane material.

11. The mat of claim 1, wherein the encapsulation comprises an elastomeric material.

12. The mat of claim 11, wherein the encapsulation comprises a mixture of an elastomeric material and a thermosetting resin, wherein the elastomeric material is crumb rubber particles embedded in a polyurethane matrix comprising at least 55 to 80% by weight of crumb rubber and 20 to 45% by weight of polyurethane.

13. The mat of claim 1, wherein the encapsulation comprises a thermoplastic material of polyethylene, polypropylene, polybutylene or a thermoplastic polyurethane, or a vulcanized rubber material.

14. The mat of claim 1, wherein the encapsulation comprises upper and lower skins having sides that are sealed together to encapsulate the mat therebetween.

15. The mat of claim 1, further comprising bumpers along the elongated sides of the mat wherein the bumpers are formed of an additional thickness of encapsulation encapsulation material so that the encapsulation has a total thickness of about 2 to about 6 inches on the elongated sides of the mat to prevent damage of the mat during use.

16. The mat of claim 1, wherein each layer, ply or support structure has a length and width that substantially corresponds to that of the mat and has a thickness of not less than 0.75 inches and not more than about 12 inches.

17. The mat of claim 1, wherein each layer, ply or support structure has a thickness of between about 1 and about 8 inches.

18. The mat of claim 1, wherein each layer, ply or support structure has a thickness of between about 1.5 and about 4 inches.

19. The mat of claim 10, wherein the thermosetting plastic material comprises epoxy, melamine formaldehyde, phenol-formaldehyde, polyester, polyurethane, polyimide, silicone formaldehyde, or urea formaldehyde, which are optionally reinforced with fibers or filler.

20. The mat of claim 11, wherein the elastomeric material is selected from the group consisting of (a) unsaturated rubbers that can be cured by sulfur vulcanization, comprising polyisoprene, cis-1,4-polyisoprene, natural rubber, trans-1,4-polyisoprene, gutta-percha, polybutadiene, polychloroprene, butyl rubber, halogenated butyl rubber, styrene-butadiene, or nitrile rubber; and (b) saturated, non-vulcanizable rubbers including ethylene propylene rubber, ethylene propylene diene rubber, epichlorohydrin rubber, polyacrylic rubber, silicone rubber, fluorosilicone rubber, fluoroelastomers, perfluoroelastomers, polyether block amides, or chlorosulfonated polyethylene.

* * * * *